US010479541B2

(12) United States Patent
DeMatteis et al.

(10) Patent No.: US 10,479,541 B2
(45) Date of Patent: Nov. 19, 2019

(54) BAG DISPENSERS, METHOD OF USE, AND MANUFACTURING PROCESS

(71) Applicants: Robert DeMatteis, Grass Valley, CA (US); Lindsey Blevin, Eureka, CA (US)

(72) Inventors: Robert DeMatteis, Grass Valley, CA (US); Lindsey Blevin, Eureka, CA (US)

( * ) Notice: Subject to any disclaimer, the term of this patent is extended or adjusted under 35 U.S.C. 154(b) by 176 days.

(21) Appl. No.: 15/551,537

(22) PCT Filed: Feb. 17, 2016

(86) PCT No.: PCT/US2016/018241

§ 371 (c)(1),
(2) Date: Aug. 16, 2017

(87) PCT Pub. No.: WO2016/134003

PCT Pub. Date: Aug. 25, 2016

(65) Prior Publication Data

US 2018/0037356 A1 Feb. 8, 2018

Related U.S. Application Data

(60) Provisional application No. 62/178,220, filed on Apr. 3, 2015, provisional application No. 62/176,495, filed on Feb. 17, 2015.

(51) Int. Cl.
*B65B 67/12* (2006.01)
*A47F 9/04* (2006.01)

(52) U.S. Cl.
CPC ..... *B65B 67/1227* (2013.01); *A47F 9/042* (2013.01)

(58) Field of Classification Search
CPC ..... A47F 9/042; A47F 13/08; A47F 9/043; B65D 33/001; B65D 33/065; B65B 67/12; B65B 67/1227; B65B 67/1233; B65B 67/1238; B62B 31/1464
USPC ... 248/690, 692, 95, 99, 100, 304, 307, 339, 248/101, 617, 215, 301, 303, 305–306, 248/322, 229.12, 229.22; 211/87.01, 211/106.01, 12, 85.15, 59.1; 206/554
See application file for complete search history.

(56) References Cited

U.S. PATENT DOCUMENTS 4,537,377 A * 8/1985 Shewchuk ..... B65B 67/1244 248/99
4,694,503 A * 9/1987 Hydorn ..... D06F 95/004 248/100

(Continued)

*Primary Examiner* — Terrell L McKinnon
*Assistant Examiner* — Michael McDuffie
(74) *Attorney, Agent, or Firm* — Advantage IP Law Firm

(57) ABSTRACT

A bag dispenser system for use with reusable bags of the self-opening or non self-opening conventional variety in which a bag dispenser includes a base constructed to mount the bag dispenser system to a support surface and an enlarged profile retainer constructed to retain a plurality of stacked bags with the bags having aligned handle apertures for inserting over the retainer to rest upon the base, and further constructed to release an outwardly facing handle of a single bag while retaining an rearmost handle of the same bag with the bag assuming an open loading configuration wherein items may be loaded into the bag and the bag removed from the bag dispenser by grasping the outermost handle and withdrawing the bag from the bag dispenser in a forward motion without any lifting to completely withdraw a single bag from the stack of bags.

11 Claims, 16 Drawing Sheets

(56) References Cited

U.S. PATENT DOCUMENTS

| | | | | |
|---|---|---|---|---|
| 5,667,173 | A * | 9/1997 | Wilfong, Jr. | B65B 43/14 248/100 |
| 6,171,226 | B1 * | 1/2001 | DeMatteis | B29C 65/004 493/227 |
| 6,382,429 | B1 * | 5/2002 | Yeh | A47F 9/042 206/554 |
| 6,698,695 | B1 * | 3/2004 | Spoto | B60R 7/02 24/567 |
| 6,715,260 | B1 * | 4/2004 | DeMatteis | A47F 9/042 248/290.1 |
| 7,318,568 | B2 * | 1/2008 | Barouta | B65D 33/001 206/554 |
| 8,820,597 | B2 * | 9/2014 | Huelke | B60R 7/10 224/311 |
| 2001/0029724 | A1 * | 10/2001 | DeMatteis | B65B 43/14 53/459 |
| 2009/0274396 | A1 * | 11/2009 | Wilkerson | B65D 33/001 383/9 |
| 2010/0314507 | A1 * | 12/2010 | Laitila | B65B 67/1227 248/97 |
| 2013/0168517 | A1 * | 7/2013 | Chu | A47K 10/12 248/304 |
| 2016/0095404 | A1 * | 4/2016 | Zech | A45C 13/001 383/15 |
| 2017/0020307 | A1 * | 1/2017 | Davis, Jr. | B65B 67/1266 |
| 2017/0055727 | A1 * | 3/2017 | Tan | A47F 13/085 |

* cited by examiner

BAG DISPENSERS, METHOD OF USE, AND MANUFACTURING PROCESS

CROSS REFERENCE TO RELATED APPLICATIONS

This application is a U.S. National Stage application of International Application No. PCT/US2016/018241, filed on Feb. 17, 2016, which claims the benefit of Application No. 62/178,220, filed on Apr. 3, 2015, and also claims the benefit of Application No. 62/176,495, filed on Feb. 17, 2015, both entitled Bag Dispensers, Method of Use, and Manufacturing Process, and which are hereby incorporated by reference in their entireties.

BACKGROUND

1. Field of the Invention

The present invention generally relates to plastic bags, their dispensers, and related bag manufacturing processes, and more specifically, relates to an efficacious plastic bag dispenser, its method of use, and the manufacture of related subject bags. The dispenser may be made from metal, aluminum, plastic, and so on, and is suitable for use in retail, supermarket, industrial/commercial, food service, and other applications.

2. Background Art

Plastic bags are commonly used in retail applications to carry groceries, merchandise, and prepared foods, and are commonly used in both service and self-serve applications. An emerging trend is the use of handled reusable bags, such as those made from thick-gauged plastic film, woven fabrics, non-woven polypropylene, and some from recycled materials such as PET. As more and more bag ban ordinances are enacted mandating the use of reusable bags, the marketplace is being filled with a mishmash of reusable handle bags. These bag styles may include flat-topped bags, wave top bags, T-shirt bags, and so on; with square bottoms, side-gussets, or bottom gussets. These bags typically have strap handles, die-cut handles, sewn and heat sealed loop handles, and so on.

Reusable bags may be purchased in the store or at the front checkout counter in response to most bag ban ordinances, which require them to be offered for sale at point of purchase. Thus, a large myriad of standing racks, hooks and holders are being used to hang the handled bags, convenient for customers to purchase. For example, turnstile racks with pegs may hold a few dozen non-woven bags and several dozen wave-top film bags. A purchaser simply removes a bag from the peg, and makes the purchase along with his/her other goods.

With bags made from film, such as wave-top bags with die-cut handles, they may also include a hook or holder, whereas several dozen bags may be mounted. These hooks are typically installed in a bagging well, or on a rack on a counter top, similar to those of present day, giveaway T-shirt bags. They may even be adapted for use on a present day T-shirt bag rack. When these reusable bags are used by baggers and checkers, they typically will remove a front bag wall from the hook, which hook then supports the rear bag wall and provides easy loading of groceries and merchandise. This bag opening operation requires some manual dexterity to carefully separate the front bag wall from the rear bag wall, and remove it from the hook.

Dispensing a bag as such, typically takes from 3-5 seconds to remove the front bag wall, pull it up and off the hook, stretch the bag outward in order to open the bag mouth, thus readying it for loading. The time frame is directly related to a person's manual dexterity and the manufacturing process associated with the bag. Some holders of this type have a second hook on an opposing side used to stretch the handle across, such as that illustrated by Robert Bateman in U.S. Pat. No. 4,750,694 (the '694 bag). A more modern version of this type of bag and system uses a similar type hook/spool as illustrated by Bateman in U.S. D699,965S1 (the '965 bag). In the case of the '694 bag and system, or the '965 bag, or any other bag on a hook that indexes the front bag wall, stretches a bag open and readies it for loading, 3-5 seconds is a relatively long time to perform the operation. This is particularly true in light of the fact that thin-gauged present day T-shirt bags are self-opening and require no manual dexterity to open a bag mouth and commence the bag loading process. While this may seem insignificant, the 3-5 seconds over the course of a year for a supermarket chain of 100 stores, using an average of only 60,000 bags per month, spends 5000-8,333 hours per month extra, just opening bags. At the modest effective rate of only $20 per hour (wages, insurances, taxes, etc.), this equals $100,000-$166,666 per month in excess labor. In other words, it costs the retailer $1.2 million to $2 million extra per year in labor costs.

Regardless of hook, spool, or otherwise, very little has changed in the last twenty years for mounting and loading bags of the wave top or die cut handle variety. Another problem associated with the '694 bag is that it is filled by a bagger or checker in a sideways manner, in other words, the opposite of how baggers are taught to bag goods, such as commonly seen with paper bags that stand up with the broader front or back panel facing the bagger. If a bag of the '694 variety is filled while partially or fully detained on a hook, the loaded bag is removed from the hook/spool by lifting it upwards, off and over the hook, and given to the customer. This lifting up operation can be difficult to execute with heavy loads and is contrary to the present bag loading operations such as with T-shirt bags, which are pulled straight forward, off the dispensing rack.

Another type of reusable bag is the present day T-shirt bag made in a thicker mil thickness (usually 0.00225-0.004 mil) to conform to the reusable bag laws. These bags can present an easy transition for a retailer as they can be mounted on the existing T-shirt bag racks. However, there are several problems associated with their use. For example, when reusing a T-shirt bag, they are difficult to stand up, prepare for loading and fill up effectively. The strap handles interfere with loading as they tend to fall inward, blocking access to the open bag mouth. Thus, when reusing these bags, the loading typically starts by loading the bag on its side, or in the case of some stores, they will try to string the bag back onto the T-shirt bag rack, thus spreading the handles outward, allowing access to the open bag mouth. Even in such a case, the bags sag downward since they are not attached to a tab on the rack, and present a poor packing surface that is not flat. Stringing a bag onto a rack usually takes about 8-10 seconds and is a relatively tricky operation. The economics of preparing a bag for loading that takes 8-10 seconds is costly as previously cited. Additional dispensing and use problems with T-shirt bags includes the simple fact that the rack takes up space and is considered a nuisance by many retailers. Retailers would gladly rid themselves of bulky, unattractive racks, especially in light of the requirement that paper and other types of reusable bags require no racks at all.

Yet another problem with present day T-shirt bags, and includes the '694 bag and system, the '965 bag and system, is that the racks or dispensing hook/spool systems interfere with the loading of a reusable bag brought in by a customer. Regardless of reusable bag type, they are all difficult to set up and prepare for loading on these systems. A checker must try to stand up the customer's bag by squeezing it in the crowded space between the other bags mounted on either a T-shirt bag rack, a '694 type rack, or a bulky inwardly-protruding '965 type spool. Unfortunately, the T-shirt bag racks, the bulky spools, and the various types of hooks and adapters are an impediment for the fast, easy, reuse of other types of bags.

One approach to eliminate the bulky spools, racks, and rack adapters used on the various types of systems previously mentioned, is to mount a simple hook in a bagging well or on a bulkhead. While ordinary hooks may save space, they do present other problems, such as the requirement for a bag to be lifted off the hook, manually made to stand up, and prepared for loading much like the system cited with the '965 spool. An alternative use of an ordinary hook of this type would be to fill the bag while one handle is mounted on the hook, then after it is loaded, lift the bag up and off the hook and put in a cart or countertop. While this may be acceptable for use in a bagging well on a relatively low bagging surface, it causes significant problems for use on a higher packing surface such as atop a counter. Likewise, for shorter users of the bag, it still represents a difficult maneuver even in a bagging well, as it then becomes imperative the loaded bag is lifted upwards. There is one other point that looms large when considering the loading of bags, which is the fact that most human beings tend to want to load a bag "just like paper", as people have been doing for over 100 years. A loaded paper bag is almost invariably pulled forward and then up and off a countertop or from a bagging well, not by lifting upwards first, and then removing it from a countertop. Ordinary hooks do nothing to improve the dispensing of a bag, improve the loading of the bag, or facilitate easy removal, nor is that their intention.

The efficient reuse of the various types of reusable bags is compounded by all of the prior art racks, spools, hooks, and adapters. It would be ideal to have a dispenser or hook that allowed all types of reusable bags to be quickly remounted so bags may be quickly stood up, and prepared for loading by a user. When doing this, the bag bottom will ideally have a flat-bottom, open disposition on a bagging surface, just like a paper bag. However, the various prior art systems are only dedicated to the use of their own bags and not the efficient reuse of other types of reusable bags. The initial use of bags on prior art systems may be efficient, but none of them will readily accept the remounting of handles of other reusable bags onto their racks, hooks, or spools so they may be in the ideal, flat-bottom, open disposition. As cited with the T-shirt bag racks it is difficult to remount even its own T-shirt bag so it correctly bottoms out. There are several reasons why prior art systems do not effectively adapt to the remounting so the various reusable bag type bottoms may rest flat in the open disposition. The designs of these hooks, spools, and tab holders, including associate adapters, are mounted at heights suitable only for their own bags, which is frequently too high, or perhaps too low, to accommodate the remounting of other bag handle styles. Compounding the issues is that some point upward, some point upward and backward, and some are too large for a handle to be remounted over it. Some hooks are so long that it becomes impractical to try to mount any bag handle over it, in an effort to support it in a flat bottom, open disposition. The reason being, it would be difficult to try to remove the bag from such as hook after it is filled. Furthermore these hooks and holders when filled with bags, actually prevent the remounting of other bag handle types unless they are wedged into place in front of a forward-most bag. Clearly all of these appliances and their related systems promote the use of reusable bags that require no handle support, otherwise they promote poor filling and loading practices, which are frowned on by retailers.

Another type of bag dispensing hook that may be used with reusable bags is illustrated in U.S. Pat. No. 6,171,226B1 (the '226) and U.S. Pat. No. 6,715,260B1 (the '260), Robert DeMatteis, co-inventor of the present invention. It incorporates a die-cut handle bag that may be efficaciously dispensed from a hook, thus saving the 3-5 seconds as required for the other types of prior art die-cut handled bags. It uses a similar self-opening methodology as T-shirt bags that automatically open. Bags based on the '226 and '260 systems have been used in the fast food trade to dispense light gauge handled bags from a hook mounted on the side of a counter. The user, a restaurant employee, grasps the open front wall of the bag and fills it in one of two following methods: 1) grasp the handle on the front bag wall, pull the bag up and off the dispenser hook, subsequently opening the bag mouth, which allows the user to use the other hand to place food inside, and last, set the bag atop a counter to complete the bagging process, or; 2) grasp the handle on the front wall of the bag, hold open the bag mouth, use the other hand to load a food article inside the bag, and then subsequently remove the bag from the hook by lifting it up and off the hook, and place the loaded bag on a counter. Either way, the bag may then be filled with other foods, such as fries, pie, or condiments. This self-opening bag operation is more efficiently conducted with the '260 system since it allows the bag to be partially filled on the hook prior to removal.

While the '226 and the '260 systems promote the use of self-opening bags that effectively eliminate the extra 3-5 seconds for opening a bag, both systems were engineered for bags to be pulled up and off the hook, automatically opened, with a first loading prior to resting on a counter top. In other words, the associated bags were not engineered to be filled while resting in an open disposition atop a checkout counter, for example, like the bags previously described in the '694 and the '965 variety, and T-shirt bags on a rack. The '226 and '260 bags may represent distinct dispensing improvements over prior art, but have a few associated downfalls. First, if it is used in conjunction with a die-cut handled reusable bag, the hooks would have all the deficiencies of the prior art hooks, spools, racks, and adapters, previously cited. For example, if adapted to use in a bagging well, they too would not be conducive to the remounting of other reusable bag handles. All of the deficiencies of remounting reusable bag handles with prior art appliances apply to the '226 and '260 hooks.

Another problem with the '226 system is that the bag must be elevated up and off the hook, which is practical with the use of smaller food bags mounted on the side of a counter, however, becomes a detriment if it were used in a bagging well. Just like with T-shirt bags (or paper bags for that matter), a filled bag that contains several pounds of goods is best extracted from its rack by pulling the bag straight forward, off the counter top, and then into a shopping cart. Being forced to pull a filled bag upwards and off a hook or rack is unnatural, and may even be a health hazard and insurance risk. The '260 system partially overcomes this problem as its bags tend to be pulled slightly less upward, and then outward. The bags in the '260 and the '226 systems freely self-open when dispensed, with the next bag in sequence remaining on the hook as, when dispensed, they abut against the upwardly disposed front piece with a top retaining edge, or an upwardly disposed wire hook. The '260 hook also requires the handle aperture to be slightly larger than the front piece, so bags may freely dispense. Likewise, it includes a base that has a width slightly larger than the aperture, in order to help keep the bag pack on the hook. This is important as it would be counterproductive to have a bag that freely dispenses from such a hook, but also causes subsequent bags to simultaneously dispense from the hook, such as in an accordion manner. The '260 hook is a significant improvement over the '226 hook in that its interconnected bags can freely accordion off its front piece. In doing so, this prior art system requires a subsequent downward motion to keep the next bags in sequence from pulling off the hook.

Regardless of the whether a first bag is dispensed from the '226 system with its upward and then downward motion, or a first bag is dispensed from the '260 system by pulling more or less straight forward, multiple dispensing of bag is an issue. This is particularly true with the last bags in a pack, and particularly true with the '260 system since the bag apertures on the interconnected bag packs are slightly larger than the front piece. While the larger width of the base provides some resistance, helping maintain the bag pack on the hook, it cannot be so great as to retain the first and at least a subsequent bag's front wall to being pulled off the base and over the slightly smaller front piece. Unfortunately, due to the variations in the die-making of handle apertures, and variations in self-opening technologies associated with plastic film bags, the '260 hook and system commonly allows the last few bags in a bag pack to stick together in an accordion manner when dispensed from a hook. This is quite similar to the problem associated with T-shirt bags that allows the last few T-shirt bags dispensed from a rack, to stick together. In both the '260 system and with a T-shirt bag rack, it is not uncommon for the last 3-4 bags to dispense being stuck together. Sometimes it can be as great as 5-6, even more. As for the '226 system, an entire pack can come off the hook if the bags if the subsequent downward motion is not applied when removing the first bag. As illustrated in FIG. 7 of the '260 dispenser hook, the front piece leans forward promoting an easier "lift" off the hook's base. However, this requires the user to adeptly move the dispensed bag downward in order to prevent the accordion effect.

It is important that the dispensing of bags using self-opening technologies (regardless of bag type and use, reusable or disposable) prevents the accordion action of interconnected bags in a bag pack. This is particularly true with reusable bags, which would cause clutter in a bagging well or countertop, and consumes additional time for a clerk to separate the bags. It furthermore creates an increase in labor time to index the extra bags, open them, and fill them with goods. In such cases it is commonplace for a clerk to instead shove the extra bags back under a counter on shelf. These bags may never be used, or sold, and may be disposed by the janitor when cleaning up late night. This also holds true for almost major retailers, whether they be soft goods stores, restaurant and fast food outlets, or otherwise. One such retailer, Sears, has cited that as much as 8% of these bags (the disposable, giveaway variety) are indeed discarded by their janitors.

Avoiding the accordion effect on bags in a bag pack used in the growing number of self-service applications is even more important. Self-service customers have less experience than hired employees and may not separate the stuck-together bags in a bag pack, thus accidentally or inadvertently they stick to a loaded bag and are then carried home, empty. A self-service customer may also separate the stuck together bags and leaves the unused bags behind. In such a case, other consumers are reluctant to pick up and use one of the discarded bags, thinking it may be defective, or it may even be contaminated from the handling of the previous consumer. This phenomena holds true in supermarket applications, whether the bags are reusable bags being dispensed at a self-service checkout counter, in the bakery section with bags being dispensed for donuts and baked goods, or perhaps by the rotisserie chicken warmer where bags are used to carry out the hot containers of roasted chicken. For example, supermarkets, such as Safeway, SaveMart, and Raleys have stated that as much as 10% of bakery bags are thrown away due to bags that are accidentally dispensed from boxes and hooks. The extra stuck-together bags either fall on the floor or are left on the countertop and will not be touched by a subsequent consumer for fear of contamination. Most bakery operations instruct their employees to keep the bakery departments clean by throwing these bags away, which also helps prevent cross contamination from contact with a prior customer or supermarket employee.

There are many other prior art systems such as Dual-Tab® bags (DeMatteis U.S. Pat. Nos. 4,759,639 and 5,497,884) that help avoid multiple-dispensing, but these bags tend to cost more. Another merited bag dispensing system is one that dispenses from a hook and leaves no residue (bag tab) behind. This is illustrated by Wilfong in U.S. Pat. No. 5,881,882 (the '882). However, carry bags with or without die-cut handles—not T-shirt bags—in this configuration tear a portion of the bag top as illustrated in FIGS. 9-12 of the '882 patent. This causes two new problems, one being a weakening of the bag top where a die-cut handle is located, and two, it creates an unattractive appearance. Overcoming the weakened area is done by making the bag longer, which raises the cost. The '226 and '260 bags on the other hand leave no tears in the bag construction. Other one-at-a-time dispensing systems for plastic bags include a multitude of roll bag configurations, most of which use a détente as a retainer to separate a bag being dispensed from the next bag on the roll. Simhaee's invention of such a roll bag and dispenser is illustrated in U.S. Pat. No. 6,234,431, Daniels' roll bag is illustrated in U.S. Pat. No. 5,209,371, and Carpenter's in US5170957 patent. While roll bags offer certain efficiencies in manufacturing, they are rarely a consideration for handled merchandise, grocery, food bags, and so on. Handles on these types of roll bags would interfere with dispensing. Likewise, they may take 10-13 seconds to complete the dispensing operation and prepare for loading.

Another detriment to many external racks, spools, and hook dispensing systems described herein, is the substantial cost to purchase and install the hardware, which frequently requires reasonably experienced employees to properly install the racks and hooks. This includes bolting down racks, hooks, holders for spools, and so on. One way or another, the end user is permanently attaching them to a counter, bulkhead, or some other type of fixture.

Plastic bags, whether they be reusable bags or otherwise, that may be efficaciously dispensed from checkout counters, self-service fixtures, and the like, in which the dispensing system may also be used to dispense other types of reusable or single-use bags, and overcome the numerous other problems associated with prior art dispensers would be valuable to these trades and many others.

SUMMARY

The disposable and permanent dispensers, plus the plastic bags and articles of the present invention, overcome the problems associated with prior art. The dispensers of the present invention dispense bags one-at-a-time by utilizing interconnected bag packs on a unique dispenser/holder that includes a retainer and a base. Properly positioned its use allows users to load bags and fill them full with two hands, then easily, efficaciously remove the bag from the dispenser/holder.

Unlike the '260 and '226 bags, the configuration of the base and retainer of the dispensing holder of the present invention allows each bag in a bag pack—from the first to the last—to dispense self-opening bags in an open disposition. More importantly, it effectively delimits multiple dispensing of the self-opening bags. Self-opening bags used on the dispensing system of the present invention may be filled on the dispensing holder, pulled straight forward, and placed in a cart or on the countertop. In this dispensing operation, the removal of the filled bag automatically opens the next bag in sequence in the bag pack. In such a case, the dispenser hook of the present invention serves to ensure that only the front wall of the next bag in sequence is opened and that an accordion chain of multiple bags does not trail behind.

The versatile dispenser/holder may be also be used to efficaciously dispense a multitude of bag types that are not self-opening. By simply mounting a pack of conventional bags, and manually pulling the front wall of the first bag in the bag pack forward, and free of the dispenser's retainer, the bag can be effectively loaded atop a counter and filled full, much like that of the self-opening bags. After the bag is filled, it is then easily pulled off the dispenser hook by pulling straight forward, again much in the same manner as a self-opening bag, without lifting it up and off the hook.

This straight-forward dispensing represents a significant advantage as it is difficult to lift up a bag filled with heavy groceries, up and over a hook. This type of lifting up and over can increase the incidence of wrist and digital injury to the user when done repeatedly over time. Likewise, the straight-forward dispensing of a loaded bag helps keep contents in a stand-up disposition, whereas pulling a bag up and off a hook does not. In the case of a spool, which is prefilled with a pack of non-self-opening bags, then mounted atop a rack type holder, its bags are likewise lifted up and off the spool, which may be somewhat easier than an elongated hook, but nevertheless, is a more difficult manual operation. Unlike the bulky spools that interfere with bag loading, the low profile of the present invention does not. Spools are also quite costly as a case of 500 bags may contain as many as 10 spools, or more. The present invention likewise saves the cost and the waste of using spools to hold bags together in bag packs, which over time can be substantial.

The dispenser/holder of the present invention may be used in many different applications. For example, when used as a merchandising aid in a supermarket, it promotes quick, easy purchases by conveniently presenting an open front wall and its handle to the consumer. The consumer simply pulls the forward-most bag off the dispenser/holder by grasping the handle, which in turn automatically opens the next bag in sequence and thus presenting its open front wall, and its handle, to the next consumer. Or, in the case of reusable bags in a supermarket environment, a single customer may dispense and purchase 3-4 bags or more. This type of instant dispensing of bags is also desirable in bakery and food applications, where 2 or more bag are dispensed to hold various types of foods. When bags are dispensed in the system of the present invention they are reliably dispensed one at a time, thus eliminating the waste from multiple dispensing of bags that are stuck together, whether in a loose pack in a dispenser box or on some sort of hook. Bags sticking together is commonplace in bakery and food applications, and is commonly reported of being around 10% or more.

In accordance with one embodiment constructed in accordance with the principles of the present invention, a bag dispenser system is provided with a bag suspending base with a mounting surface constructed to be secured to a support surface, the base having an outwardly facing profile when mounted to the support surface, the outwardly facing profile at least partially defined by an upper perimeter, a side perimeter, and an opposing lower perimeter, the upper perimeter being constructed to suspend a plurality of bags, each bag having a front panel with a front handle defining a front handle aperture and a rear panel with a rear handle defining a rear handle aperture aligned with the front handle aperture and further provided with a bag retainer extending upwardly from the upper perimeter of the base to define an upper handle retention member with a rearwardly facing bag handle retention surface and further extending either outwardly from a side perimeter to form a side handle retention surface, and/or downwardly from the lower perimeter of the base to define a lower handle retention member with a second rearwardly facing bag handle surface, the retention members defining a slightly enlarged outwardly facing retainer profile relative to the outwardly facing profile of the base, the bag retainer constructed to slidably receive a plurality of bag handles over the upper and lower retention members to dispose the bag handles between the retention members and the support surface when the base is mounted thereon, the bag retainer further constructed to permit withdrawal of a front handle of a single bag from the bag retainer and the base when the front handle is pulled away in a first direction from the bag retainer without any lifting motion while releasably retaining the rear handle of the same bag on the base at least partially behind at least one retention member to space apart the front and rear handles of the corresponding bag and present an open loaded configuration wherein the bag may be loaded with one or more items and then further released completely from the base and retainer by pulling the bag again in the same direction as the first direction.

In another embodiment, the bag dispenser may be loaded with self-opening bag packs, non self-opening or conventional bag packs, and/or reusable bags of either variety.

In another aspect of the invention, the bags are inhibited from being removed more than one at a time.

Another embodiment constructed in accordance with the principles of the present invention includes a novel type of cleat used to secure a bag handle and hold it in place so it may be effectively loaded without the handle accidentally coming loose. One variety of this cleat may be in a similar form as a cam cleat that allows a user to quickly clinch a bag handle in place, thus securing the bag in an open disposition. After a bag is loaded on the cleat, it is easily dispensed by releasing the bag handle from the cleat and then pulling straight forward off its front retainer.

The dispensing operation of the dispenser/holder of the present invention bags is natural, intuitive to users, as they may load and dispense a filled bag much like they would a traditional T-shirt bag on a rack (only without the cumbersome rack). The system used on the dispenser/holder of the present invention may even mimic the filling and loading of a paper bag, which once filled, is pulled straight forward, then off the countertop and placed into a shopping cart or handed to a customer. Whether a bag is self-opening or not, the use of handled bags on the dispenser/holder of the present invention requires no training. All of these attributes can also be said for the use of bags on the cleat.

Various mounting systems and methods of use are also disclosed herein.

The objectives of the present invention are listed in part as follows, however, by no means should the list be considered limiting to the overall broad scope of the present inventions and the multitude of variations on the theme:

1. A dispenser/holder that allows self-opening bags in a bag pack to automatically open a next bag in sequence when the forward most bag is dispensed.

2. A dispenser/holder that delimits the multiple dispensing of self-opening bags.

3. A dispenser/holder that prevents the last bags in a self-opening bag pack from accidentally dispensing due to an accordion effect.

4. A dispenser/holder that allows bags to be pulled straight forward, released from a retainer.

5. A dispenser/holder that allows the front wall of a bag to be pulled straight forward, released from a retainer, while the rear bag wall remains securely in place.

6. A dispenser/holder that allows the front wall of a bag to be pulled straight forward, released from a retainer, while the rear bag wall remains securely in place, thus allowing the bag to be loaded.

7. A dispenser/holder that allows bags to be filled while being supported in an open disposition with a rear handle resting atop its base.

8. A dispenser/holder that allows bags to be filled while being supported in an open disposition with a bag bottom resting atop a horizontal loading surface.

9. A dispenser/holder with a retainer of a suitable size and perimeter that allows one or more bag handles to be fixedly mounted over it, yet allows a forward most handle to be removed by pulling straight forward.

10. A dispenser/holder with a retainer of a suitable size and perimeter that allows one or more bag handles to be fixedly mounted over it, yet allows a forward most handle to be removed by pulling in one or more of the following directions: straight forward, sideways, upwards, or downwards.

11. A dispenser/holder with a retainer of a suitable size and perimeter that allows one or more bag handles to be fixedly mounted over it, whereas the one or more handles rests atop a base, and said retainer then allows a forward most handle to be removed by pulling straight forward.

12. A dispenser/holder that can be quickly mounted like a peg hook, in a slot, or other type of aperture surface.

13. A system of dispensing a bag in which the front wall of the forward-most bag is pulled forward presenting a bag in an open disposition suitable for loading.

14. A system of dispensing a bag that allows the bag mouth of a dispensed bag to be substantially large and open, stay open, and thereby facilitating loading.

15. A system of dispensing a bag that allows the bag mouth of a dispensed bag to be substantially large and open, whereas a rear wall securely retains the bag on a holder thereby facilitating loading.

16. A system of dispensing a self-opening bag in which the front wall of the forward-most bag is pulled forward presenting a bag in an open disposition suitable for loading.

17. A system of using a bag in which the rear wall of a bag is retained on the dispenser/holder, the front wall is free and the bag is loaded with goods.

18. A system of using a bag in which the rear wall of a bag is retained on the dispenser/holder, the front wall is free, the bag is loaded with goods, and the bag is then removed from the dispenser/holder by pulling straight forward.

19. A system of dispensing a self-opening bag in which the next bag in sequence is securely retained on a dispenser/holder.

20. A system of loading a bag on a dispenser/holder and subsequently dispensing it by pulling straight forward.

21. A system of loading a bag on a dispenser/holder and after it is filled, it automatically pulls open the front wall of the next bag in sequence.

22. A system of dispensing a self-opening bag in which the next bag, or bags, in sequence does not accordion.

23. A system of dispensing a self-opening bag in which the front wall of the forward-most bag is in an open disposition suitable for a user to grasp and dispense, thus presenting the next bag in sequence to be dispensed in a like manner.

24. A system of dispensing a self-opening bag in which the front wall of the forward-most bag is in an open disposition suitable for a user to grasp an adjacent handle and dispense said bag, thus presenting the next bag in sequence to be dispensed in a like manner.

25. A holder that secures a bag handle in place for subsequent loading.

26. A holder that accommodates the securing of various bag types and sizes.

27. A holder that accommodates the securing of various types of bag handles in place so the bag may stand up for subsequent loading.

28. A holder in the form of a cam cleat that allows a user to securely clinch and maintain a bag handle in place for subsequent use.

29. A holder that secures a bag handle in place for subsequent loading and subsequent removal of said bag by pulling straight-forward.

30. A system of clinching a bag handle on a holder, loading the bag, and removing it.

31. A system of clinching a bag handle on a holder, loading the bag, and removing it by pulling straight forward.

32. A system of mounting a dispenser/holder onto a pegboard.

33. A system of mounting a dispenser/holder into a slot.

34. A system of mounting a dispenser/holder by inserting a mount in an aperture-opening.

35. A dispenser/holder that is mounted in an aperture-opening.

36. A bag dispensing hook mounted in an aperture-opening.

Furthermore, it is an object of this application to illustrate various preferred embodiments of a dispenser/holder and its various methods of using and dispensing bags, as well as the ability to quickly mount and attach to various types of bulkheads, surfaces, mounts based on the desired application and system uses.

All of the embodiments summarized above are intended to be within the scope of the invention herein disclosed. However, despite the discussion of certain embodiments herein, only the appended claims (and not the present summary) are intended to define the invention. The summarized embodiments, and other embodiments and aspects of the present invention, will become readily apparent to those skilled in the art from the following detailed description of the preferred embodiments having reference to the attached figures, the invention not being limited to any particular embodiment(s) disclosed.

DETAILED DESCRIPTION

For ease of explanation, only a few embodiments constructed in accordance with the principles of the present invention will be described in detail. Any person who is experienced in the art will understand how a multitude of versions with their related systems, may thereby be made and used.

Figure 16A:
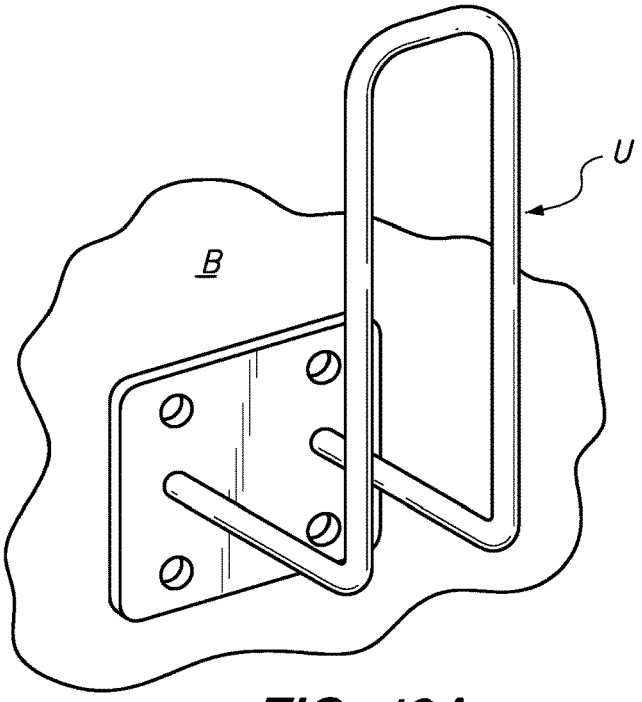
FIG. 16A is a perspective view of a typical prior art hook that would be mounted on a bulkhead.
Figure 16B:
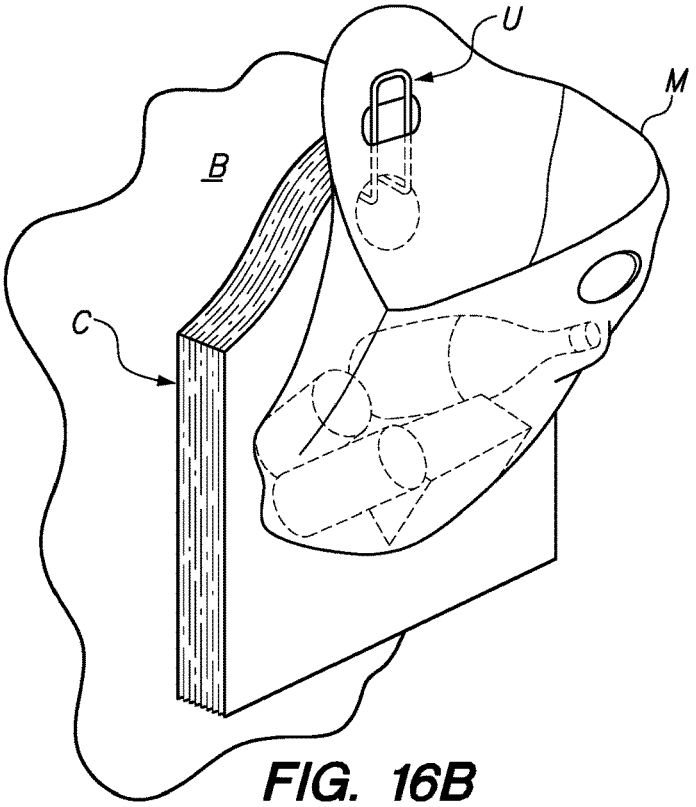
FIG. 16B is a perspective view of the prior art hook in FIG. 16A illustrating how bags are tipped when removed from the hook, upsetting the contents.

In FIGS. 16A and 16B, a typical prior art hook U is mounted on a bulkhead B with a bag pack C mounted on the hook U. As shown in FIG. 16B, a forward-most bag M is being removed from the hook U by pulling upwards and off the hook U. As shown in FIG. 16B, the contents in bag M, illustrated by dashed lines, are being upset as bag M is pulled up and off the prior art hook U. This is a commonplace occurrence, which generally forces a user, such as a bagger or checker in a retail store, to instead, pull the bag completely off the hook prior to loading, and do his/her best to stand the bag up, then load it. Unfortunately, doing this promotes the time-consuming, costly, and awkward bagging techniques previously cited in the Description of Prior Art. It may also aggravate customers when improperly filled bags fall over in their car trunks or back seat floors.

Figure 1A:
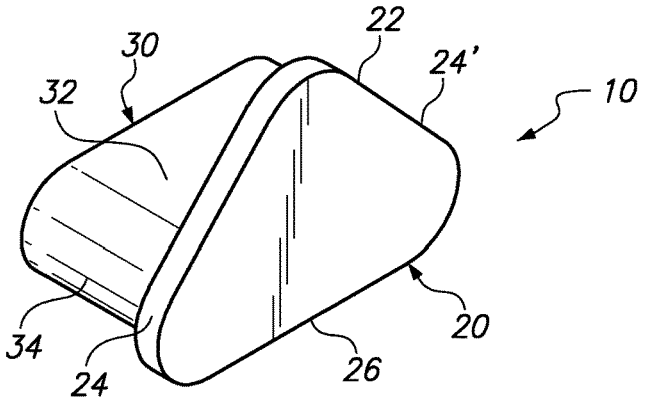
FIG. 1A is a front perspective view of a dispenser/holder of the present invention.
Figure 1B:
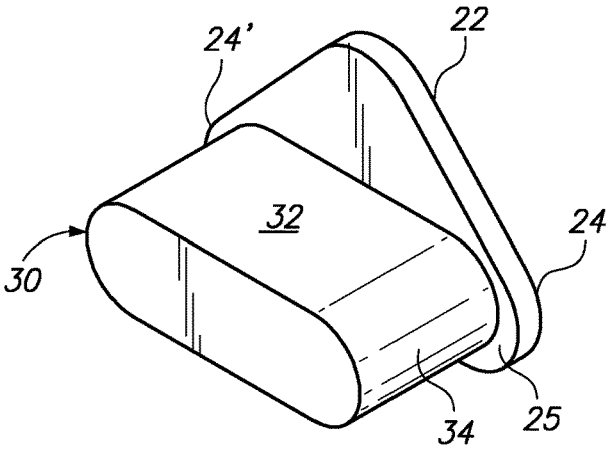
FIG. 1B is a rear perspective view of a dispenser/holder of the present invention.
Figure 1C:
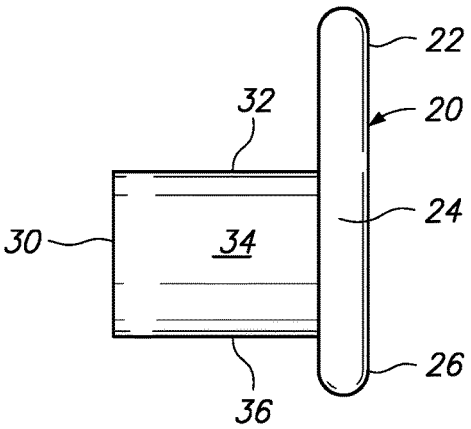
FIG. 1C is a side view of a dispenser/holder of the present invention.

In FIGS. 1A, 1B, and 1C, a first embodiment of a dispenser (or holder), generally designated 10, and constructed in accordance with the principles of the present invention includes a retainer 20 and a base 30. The retainer 20 has an upper perimeter 22 that extends above a top surface 32 or upper perimeter of the base 30 by a modest dimension to provide an upper bag retention member with a rearwardly facing bag handle surface extending from the base to the upper perimeter 22 of the retainer, which is determined by the size of a bag handle aperture to be mounted on the dispenser/holder. For example, if a handle has an overall height of 2"-3", the retainer may extend above the top surface 32 by ½" up to 1" or perhaps more depending on the overall size of the bag and its handle, and the amount of contents it will be holding. Generally speaking the larger the bag and/or the handle, the taller the extension. The outer side perimeters 24 and 24' of retainer 20 typically extend out past side base portions 34 and 34' (not shown) or side perimeters of the base 30 in a generally lateral direction at point 25 by a modest margin, for example ¼" past the width of base 30 to provide left and right bag retention members, respectively, each having a rearwardly facing bag handle surface extending from the respective outer base surface to the perimeter 24, 24' of the retainer 30. The lower perimeter 26 of retainer 20 also extends out past the lower base portion 36 or lower surface or perimeter of the base by a modest margin, for example ¼", to provide a lower bag retention member with a rearwardly facing bag handle surface extending from the lower base surface 36 to the lower perimeter 26 of the retainer 20. The upper surface or perimeter 32 of the base, the left and right side surfaces or perimeters 34, 34' (not shown but a mirror image of perimeter 34), and the bottom surface or perimeter 36 of the base 30 cooperate to define an outwardly facing profile that is reduced relative to the outwardly facing profile of the retainer 20. In other words, the outwardly facing profile of the retainer 20 is enlarged relative to the outwardly facing profile of the base 30, albeit the differences in the profiles may be slight. The configuration of the perimeter of retainer 20 may be of any number of sizes and shapes, for example, wide and narrow, generally rectangular, round, oval, or otherwise depending on the types of handles it will be holding. Illustrated in FIGS. 1A, 1B, and 1C is a version that tends to work well with a multitude of handle styles and configurations commonly used in the trade. It is also important to note that the size, configuration and location of the upper surface 32 of the base 30 is of no small importance as it must be of a suitable size and configuration to maintain a bag handle up high (as opposed to allowing a bag handle to sag down as may be the case with an incorrectly sized base) in order to preferably dispense bags in a straight-forward manner as illustrate in the subsequent figures. Likewise, the size, shape, and configuration of retainer 20 are also of importance when used to dispense self-opening bags, which is also illustrated herein.

The configuration of the dispenser/holder in FIGS. 1A, 1B, and 1C would ideally be made of plastic, however could be made out other material types as well, such as metal, even wood. Likewise it may have holes drilled through base 30 for mounting onto a bulkhead, or may have a mounting plate attached to the rear surface of base 30. It may also have a wire-formed mounting adapter to be attached to existing racks and holders. It is not the intention of illustrating the various means of attaching the present invention in FIGS. 1A, 1B, and 1C, to limit the attachment regions to a vertical bulkhead or perhaps a horizontal packing surface, or to limit the attachment means to only those novel means of attachment cited in FIGS. 10-12.

The dispenser/holder in FIGS. 1A, 1B, and 1C, may also be made with much smaller dimensions and may serve more as a pin stacking system, instead of a handle support. For example, instead of supporting a 2½" bag handle aperture, a very small aperture, perhaps one as small as 'A", may be used as one or more mounting holes for a pack of header bags, Dual-Tab® bags of DeMatteis' '884 variety, wicketed bags, or those of Wilfong's '882 variety. In such a case, the retainer may extend above the base as little as ⅛". In such a case it would most likely be preferable to have two apertures located near the bag top that mount onto two smaller dispenser/holders spaced apart the same distance as the bag apertures. In this wicketed bag replacement scenario, it would be typical to dispense the bags from a horizontal surface, whereas air inflates a forward-most bag. While not illustrated herein, it will become clear to those skilled in the art to recognize that the same principles used by the dispenser/holders described herein in the present and following figures, with their unique attributes, may be applied to such apertured bag types and more.

Figure 2A:
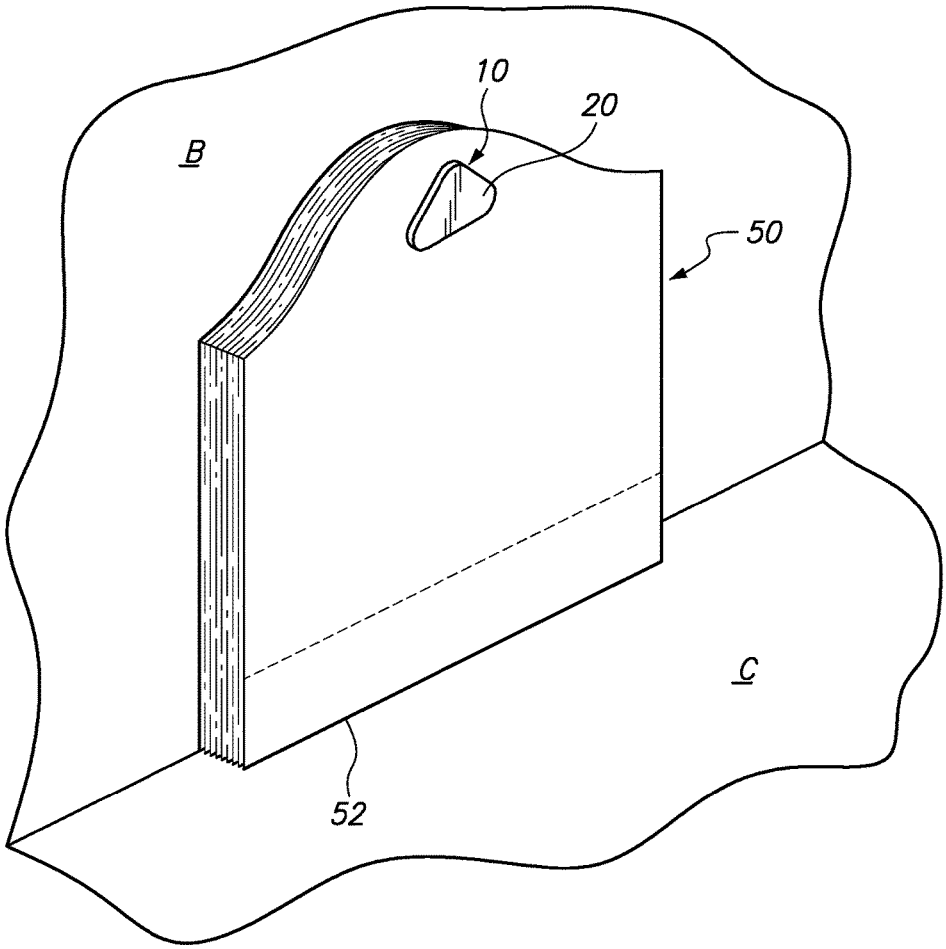
FIG. 2A is a perspective view of the dispenser/holder in FIGS. 1A, 1B, and 1C with bags mounted on it.
Figure 2B:
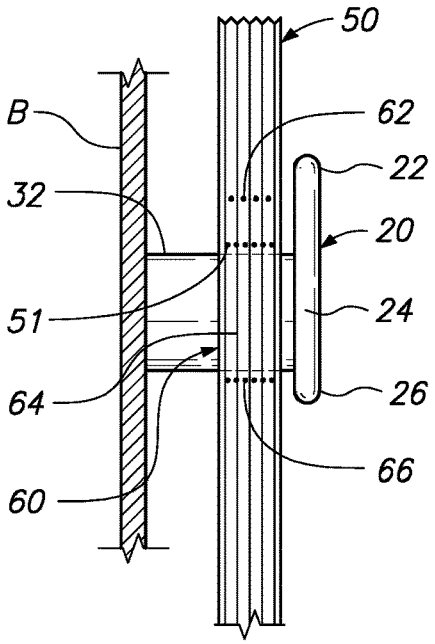
FIG. 2B is a side view of the dispenser/holder in FIGS. 1A, 1B, and 1C with bags mounted on it.

In FIGS. 2A and 2B the dispenser/holder 10 of FIG. 1 has a bag pack 50 mounted on it through its generally oval aligned handles 60. In FIG. 2A dispenser holder 10 is mounted on a vertical surface, bulkhead B, at a height that allows bag bottoms 52 to rest atop countertop C. This desired disposition will be subsequently explained in FIGS. 4A and 4B. As illustrated bag pack 50 rests sufficiently high up on base upper surface 32 at location 51 (dotted lines) to allow the mounting of aligned bag handles 60 onto dispenser/holder 10 and to facilitate the dispensing of the bags in bag pack 50 as described in the following figures. As illustrated, the upper perimeter 62 (dotted lines) of aligned bag handles 60 is below upper retainer perimeter 22, a side perimeter 64 of aligned bag handles 60 is located inside side retainer portion 24, and the lower perimeter 66 of aligned bag handles 60 is located above lower perimeter 26. As illustrated, the lower perimeter of aligned bag handles 60 is in a disposition near or above retainer perimeter 26 serves an additional function with self-opening bags, which shall be subsequently described. The overall unique, yet carefully engineered, proportions and dimensions of retainer 20 along with the generally smaller outer perimeter of aligned bag handles 60, provide a versatile means of mounting and subsequently dispensing and using a relatively large number of bags with a large number of die cut handle sizes and types by pulling a loaded bag straight forward and removing them from the dispenser/holder after loaded.

Figure 3:
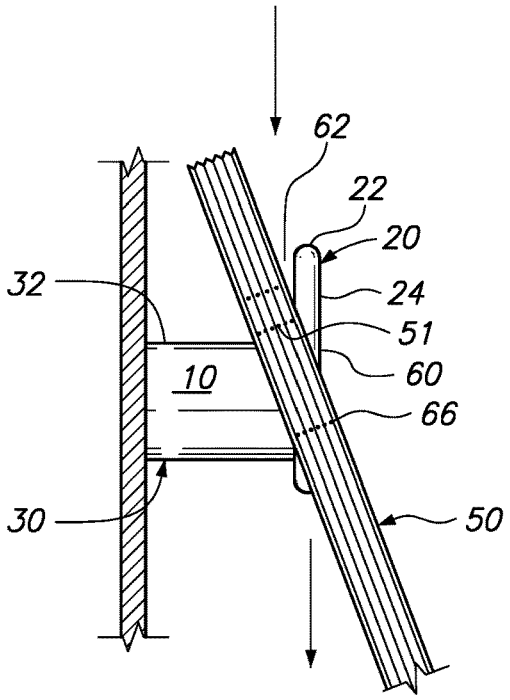
FIG. 3 is a perspective view of the dispenser/holder in FIGS. 1A, 1B, and 1C illustrating how bags are mounted.

In FIG. 3, the bag pack 50 is being mounted onto dispenser/holder 10 by slipping aligned handles 60, whose upper and lower perimeters are defined by the two sets of dotted line perimeters 62 and 66 respectively, over retainer top perimeter 22 of retainer 20. As bag pack 50 is pushed downward (indicated by arrows), it slides over side perimeters 24 and 24' (not shown) and will then rest atop top base surface 32 of base 30 at handle location 51 (dotted lines) as illustrated in FIG. 2B. The aligned bag handles 60 may be slightly stretched as they slide over side perimeters 24 and 24' if it is a tight fit, but the tight fit still allows the flexible plastic material around any given bag handle to slip off the retainer when a single bag is dispensed. In this bag mounting operation as shown, bag pack 50 is securely fixed on the dispenser/holder 10 but still releasable, whereas the handle perimeter is somewhat smaller and lies behind the retainer perimeter as previously illustrated in FIGS. 2A and 2B. This disposition is considered ideal for dispensing bags one at a time, whereas a rear bag handle will not easily fall off the dispenser/holder of the present invention until forcibly removed. The retention of a bag handle on a dispenser/holder of the present invention is primarily due to the perimeter of the bag handles being smaller than the perimeter of the retainer. However, a similar retention may also be accomplished with bag handle perimeters being larger than retainer perimeters. As long as the retainer is larger than the base on one or more sides, the perimeters of the retainer serve as an abutment to a handle edge helping maintain it in place.

Figure 4:
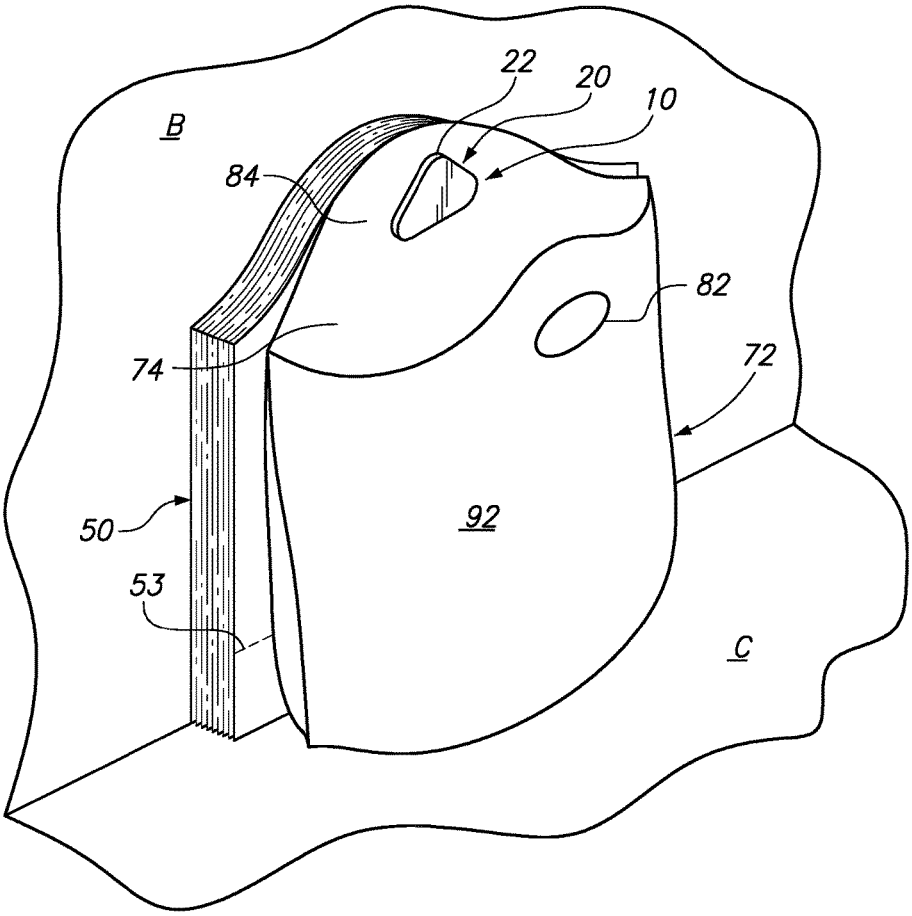
FIG. 4 is a perspective view of the dispenser/holder in FIGS. 1 and 2 with a front bag wall of the forward-most bag in the bag pack in FIG. 2 pulled forward, free from the retainer.

In FIG. 4, each bag in bag pack 50 has an expandable bottom gusset 53 that allows a dispensed bag to open up and bottom out atop surface C when dispensed. Forward-most bag 72 has its front bag handle 82 in front bag wall 92 pulled forward, dispensed free from retainer 20 presenting a bag mouth 74 in an open disposition, thus ready for loading. The removal of front bag handle 82 from dispenser/holder 10 is facilitated by its somewhat flexible material that allows it to "pop over" retainer 20 and its upper perimeter 22, meanwhile rear bag handle 84 is retained securely behind retainer 20 on dispenser/holder 10. As illustrated the bottom gusset of forward-most bag 72 has expanded has bottomed out atop countertop surface C, presenting a highly desirable open-mouth loading disposition. In this disposition, loading like a paper bag is fairly easy to do. It is also interesting to note that when a bag is pulled completely off dispenser/holder 10 by grasping the front bag handle and pulling forward, then releasing the rear handle from the retainer, the bag mouth will then be in an open disposition. A user may then easily manipulate the open-mouthed bag to stand up on a countertop, by inserting a hand inside and finding the bag bottom. In comparison, bags that are lifted up and off of a prior art hook, require the user to separate two plies to open the bag mouth, next blouse it open, and last find the bottom on a countertop. The preferred process of simply removing a bag off of dispenser/holder 10 to prepare for loading, can represent a significant time savings.

Figure 5A:
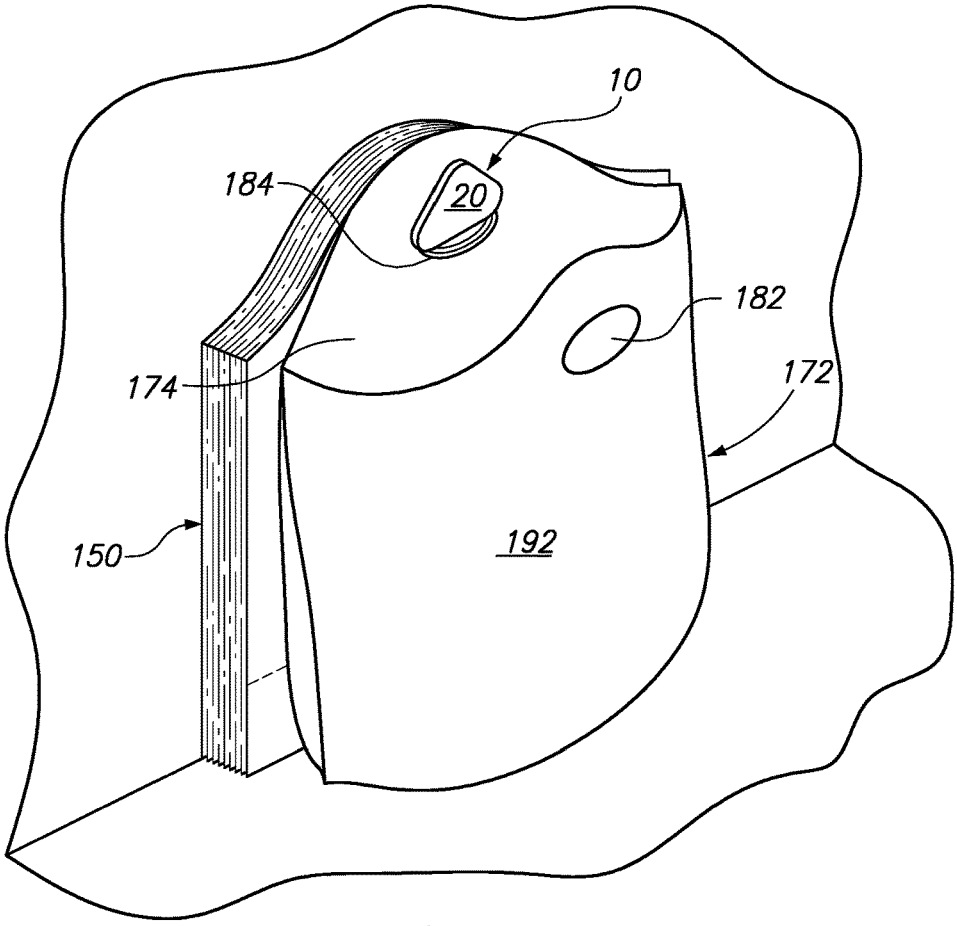
FIG. 5A is a perspective view of the dispenser/holder in FIG. 1 with a front bag wall of the forward-most bag in a bag pack with round handles, free from the retainer.
Figure 5B:
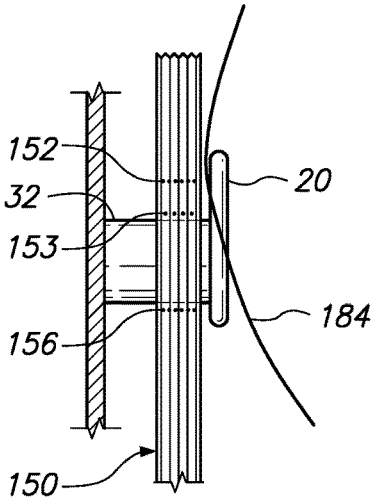
FIG. 5B is a partial side cutaway view of the bag in FIG. 4B, loaded with goods, being pulled straight-forward off the dispenser/holder.

In FIGS. 5A and 5B, the bag pack 150 has round handles defined by an upper perimeter 152 (dotted lines), a lower perimeter 156 (dotted lines) and rests atop base 32 at location 153. Forward-most bag 172 has its round front bag handle 182 in front bag wall 192 pulled forward (arrows), free from the retainer 20 presenting bag mouth 174 in an open disposition, thus ready for loading. The removal of round front bag handle 182 from dispenser/holder 10 is facilitated by pulling it forward, or slightly up, over and off retainer 20. After releasing front bag handle 182 from dispenser/holder 10, the rear bag handle 184 remains retained behind retainer 20 along its upper and side perimeters. While this may not be as desirable as the bag pack and holder of FIG. 4, it nevertheless is a significant improvement over prior art hooks, spools, and so on. This retention of a bag with handles that are larger than the retainer's perimeter may be effected by one or more top, side, or bottom perimeter portions on a dispenser/holder that serve as a means of abutment to at least one or more outer handle perimeters. The loading functionality of the bag and its removal from dispenser/holder 10 is typically enhanced much like that illustrated in FIG. 4 whereas an expandable bottom gusset bottoms out on a horizontal surface.

Figure 6:
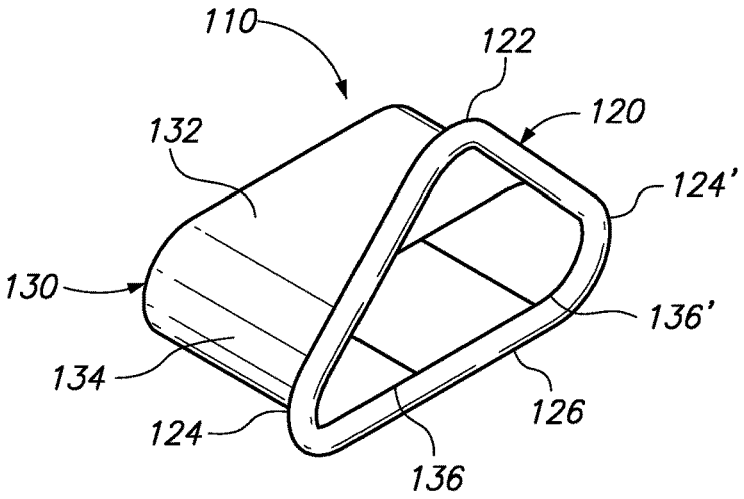
FIG. 6 is a perspective view of a variation of the dispenser/holder in FIGS. 1-5 made from wire and metal.

In FIG. 6 dispenser/holder 110 is made from metal and works much like that of dispenser/holder 10 of FIGS. 1A, 1B, and 1C. Dispenser/holder 110 has a wire retainer 120 and a metal base 130. Retainer 120 has an upper perimeter 122 that extends above the top surface 132 of base 130 by a modest dimension, which is determined by the size of a handle aperture to be mounted on the dispenser/holder. The outer side perimeters 124 and 124' of retainer 120 typically extend out past side base portions 134 and 134' (outer surface is not shown) of base 130 in a generally lateral direction and function much like that of dispenser/holder 10. The lower perimeter 126 also extends below lower base portions 136 and 136' by a modest margin. The configuration of the perimeter of retainer 120 may be of any number of sizes and shapes, for example, wide and narrow, generally rectangular, round, oval, or otherwise depending on the types of handles it is best suited to hold. Otherwise, dispenser/holder 110 functions and allows bags to be dispensed in much the same manner as dispenser/holder 10.

Figure 7A:
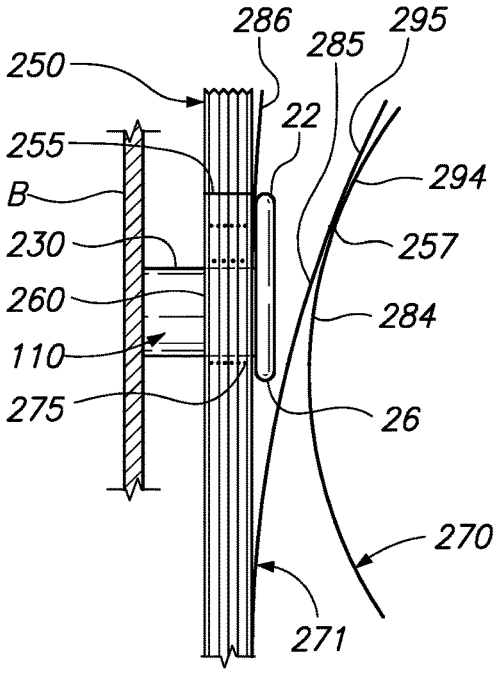
FIG. 7A is a side view of the dispenser/holder in FIG. 6A with a bag pack of self-opening bags mounted on it, illustrating how a forward-most bag self-opens the next bag in sequence.
Figure 7B:
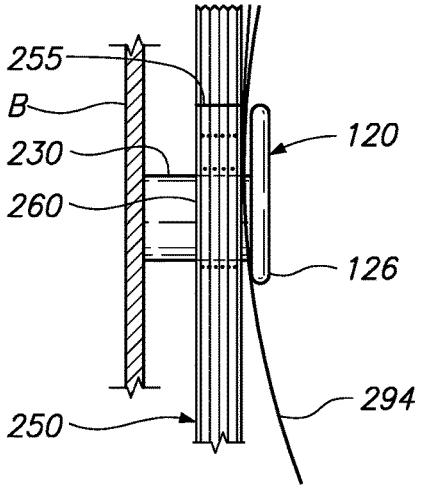
FIG. 7B is a perspective view of the bags and dispenser/holder in FIGS. 6A and 6B, illustrating how the retainer prevents the accidental multiple dispensing of the next bag in sequence, when a forward-most bag is removed.

In FIGS. 7A and 7B, dispenser/holder 110 of FIG. 6 is mounted on a bulkhead B and contains a bag pack 250 mounted on it. Bag pack 250 is the same style as bag pack 50 in FIG. 2 but are of the self-opening variety (bags are interconnected on their upper, outer surfaces similar to those illustrated in the '260 and '226 patents). Bag pack 250 has its aligned handles 260 mounted atop base 230 much like the previous bags in FIGS. 2-4. However, bags in bag pack 250 are manufactured to certain preferred specifications suitable for automatic dispensing from dispenser/holder 110 one at a time without causing an accordion effect. For example, the manufacturing specification for bag pack 250 includes interconnects of individual bags 255 above the die-cut handle region (thick dark line) in order to cause the rear handle on the rear wall of a forward-most bag to separate from its abutment to the retainer's perimeter, and simultaneously allow the front handle on the next bag to follow. In doing so, the lower perimeter of the rear handle on the next bag in sequence then abuts the retainer's perimeters, in particular the lower one, keeping the bag on the dispenser/holder. One key to this being a reliable, consistent phenomenon is to have the self-opening interconnection being strong enough to pull the top of the next bag in sequence, but weak enough to separate when the rear wall of the next bag in sequence abuts the retainer. Without the abutment effect, the reliable, self-opening of only one bag at a time is not reliable. This type of bag-making specification in concert with the self-opening methodology described herein substantially prevents wastage by substantially reduce multiple dispensing, in particular the last bags in a bag pack.

The self-opening dispensing operation begins in FIG. 7A when forward-most bag 270 (not shown in its entirety) is being removed from dispenser/holder 110, and its rear bag wall 294 pulls forward the front bag wall 295 of next bag in sequence 271 (not shown in its entirety) at interconnection 257, and both rear bag handle 284 (delineated by dots), and front bag handle 285 (delineated by dots) of next bag in sequence 271 "pop up and over" upper retainer perimeter 22. Forward-most bag 270 is then separated from the interconnected next bag in sequence 271. As illustrated, the bottom perimeter 275 of rear bag handle 286 on the next bag in sequence 271, abuts up against the bottom perimeter 26 of retainer 20. This abutment serves as an excellent means to prevent the accordion effect of the multiple dispensing of interconnected bags. This reliable one-at-a-time dispensing on dispenser/holder 110 works equally as well on dispenser/holder 10, and any others utilizing comparably engineered retainers with outer perimeters. Once engineered, in concert with suitably manufactured self-opening bags, it should be sufficient to induce a bag handle to pop up and over the upper perimeter by pulling more or less straight forward, yet, weak enough to break when the next bag in sequence abuts up against preferably more than one outer perimeter on the retainer.

The self-opening operation in FIG. 7A is completed as illustrated in FIG. 7B when the rear bag wall of the next bag in sequence being fixedly retained behind retainer 120 by abutting flush up against retainer 120 perimeters (upper, side and lower), most importantly lower perimeter 126. This is when the rear bag wall of the forward-most bag separates from its interconnection with the front bag wall of the next bag in sequence. As revealed in the '260 and '266 patents the lack of outer perimeters (other than the simple retaining hook or portion on the top) allows multiple dispensing of bags if the user is not careful. However, lower perimeter 126 serves to abut, or "snag the next bag handle in sequence", before it is accidentally dispensed in accordion fashion. It is also interesting to note that with bag packs such as 250 with interconnections such as 255, the common bond tends to maintain the bags up higher above the dispenser base, and inside the outer perimeters of the retainer. This phenomena improves the prevention of multiple dispensing, and improve the ability of the rear wall of a bag being loaded, to stay mounted on the retainer, as illustrated in FIG. 7B.

This self-opening methodology and its related dispenser/holders and systems may be used with bags being loaded on countertops, bagging wells, shelves, off a vertical bulkhead with or without a bagging surface, in a horizontal mount, and so on. The versatility of the present invention may be incorporated with bags of all types and sizes—large and small—including heavy-gauge reusable bags, lightweight disposable bags, and so on. This self-opening methodology and related systems may also be applied to any number of apertured bag articles, regardless of size. As previously stated, it may be applied to very small apertures, for example as small as ¼", on bags that may use in place of Dual-tab, header and wicketed bags. The advantage of doing so results in the elimination of metal wickets, cardboard and plastic headers and staples.

It will be appreciated that the function of retaining a self-opening bag, other than self-opening bag (non self-opening), and/or reusable bag to the dispenser 10, such as those shown in FIGS. 1-7B is facilitated by using bags with bag handle apertures that are smaller in one dimension than the overall similar dimension of at least two retainer members. For example, the bag handle aperture width may be smaller than the width of the outer perimeter of the two opposing side retention members. Similarly, the bag handle aperture height may be smaller than the height of the upper and lower retention members as measured from their respective outer perimeters. In addition, the distance of the bag handle apertures from the top to a side may be smaller than the distance from the upper perimeter of the upper retention member to the outer perimeter of a side retention member. As a numerical example, two side retention members may have outermost perimeters with a combined dimension that equates to a 2.5 inch width (or outer profile) while the profile of the base only measures two inches wide. Any bag with a bag aperture measuring less than 2.5 inches in width would be releasably retained on the dispenser behind the left and right retention members. A similar example may be used for the upper and lower retention members or any combination of an upper retention member and at least one side retention member, the upper retention member and the lower retention member, the lower retention member and at least one side retention member, two side retention members, and all four retention members as each combination may be used to cooperate to retain the bag on the dispenser as described herein. What is particularly useful for releasably engaging the bags is to engage at least two portions of the perimeter of the bag aperture with two like situated portions of the retention members. While at least two opposing portions of the retention members are preferred to releasably retain the bag, this is not meant to be limiting.

To put the relationship between the bag handle apertures, base profile, and retainer profiles another way, the bag handle apertures define a first distance or dimension spanning across the aperture. The base profile defines a second distance spanning its outwardly facing profile. The retainer defines a third distance between two spaced apart points on the perimeter of at least one of its retention members (upper, lower, left, right). These distances may be height (vertical), width (horizontal), or on a diagonal. What is useful for retaining the bag handles on the dispenser is that the third distance is greater than both the first distance defined by the bag handle apertures and the second distance as defined by the base when these distances are aligned in the same direction so that the retainer resists, at least temporarily, the release of the bag handles at two or more points along the perimeter of the bag handle aperture when suspended on the base. It will further be appreciated that the retention members may be defined using a combination of perimeters such as upper left, upper right, lower left, lower right or other position combination. A flexible or stretchable perimeter around the bag handle aperture is also useful in providing a stretch fit over the retainer with the bag handle aperture being narrower in dimension than the retainer.

Figure 8A:
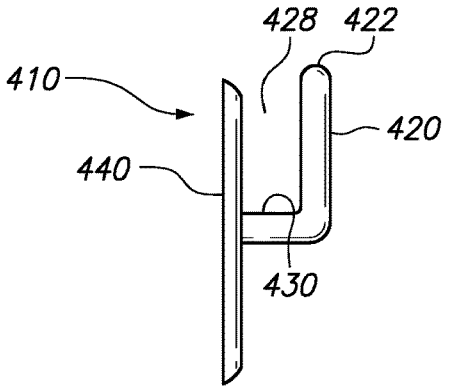
FIG. 8A is a side view of a low profile cleat of the present invention.
Figure 8B:
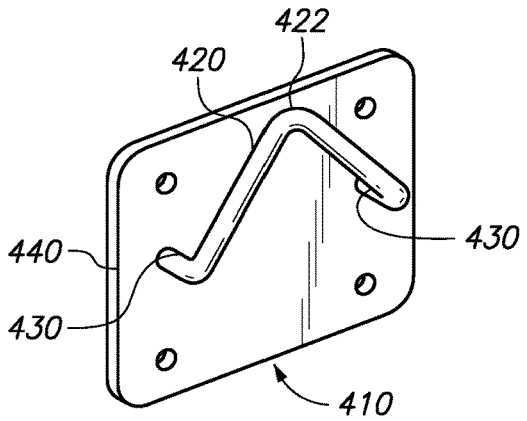
FIG. 8B is a perspective view of a low profile cleat of the present invention.
Figure 8C:
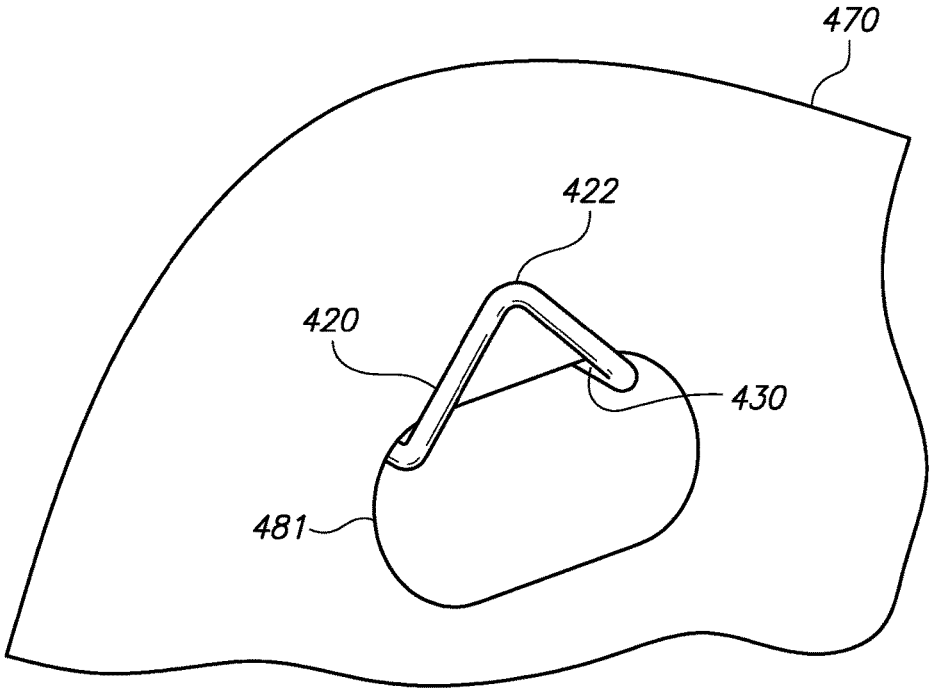
FIG. 8C is a perspective view of a low profile cleat of the present invention with a bag handle secured on it, in order to maintain a bag in an open disposition for loading.

In FIGS. 8A, 8B, and 8C, a low profile cleat 410 constructed in accordance with the principles of the present invention is shown with a retainer 420, a base 430, and a back piece 440, and is further illustrated with a single bag handle 481 secured behind the retainer 420. An individual bag 470 (not shown in its entirety) would be loaded, and subsequently dispensed from the cleat much like the bags and methods previously illustrated with the systems cited in FIGS. 1-5 with dispenser/holder 10. The gap 428 between retainer 420 and back piece 440 is ideally narrow enough to retain a bag handle in place without accidentally "falling out" while bag 470 is being loaded. This narrow holder is not intended for the use with bag packs, but for use of individual bags. The retainer is also of a low enough profile from its base to its upper perimeter 422 that it allows a loaded bag to be pulled straight forward, or perhaps slightly upward, in a manner more or less the same as has been previously described with bags dispensed from the present invention dispenser/holders 10 and 210. The dimensions of the retainer of the low profile cleat may seem somewhat generic, however, it is important to keep in mind that prior art hooks and spools do not allow for efficacious use of bags with various types of bag handles, with the ability of being able to fill it and pull it straight forward and off the retaining hook. Prior art hooks in fact, teach the opposite in that they force a user to lift a bag up and off the hook, and then fill the bag in an unsupported disposition. In contrast, the present invention of low profile cleat 410 allows a bag to be filled in a supported disposition, with a single handle secured in gap 428, then easily dispensed by pulling straight forward, without lifting up the bag, or in some cases, lifting it up only slightly. As stated with the dispenser/holder 10 it is desirable to mount the cleat 410 (and 510 as will illustrated in FIGS. 9A, 9B, and 9C) at a height above a packing surface that allows bags to bottom out, so that they may be supported in an open, stand-up disposition, and loaded similar to a paper bag.

The only exception of loaded bags that may be dispensed in an upward motion might be when they are filled in a bagging well at a checkout counter and subsequently lifted up and placed into a shopping cart or checkout counter. While this may be the case with many checkers, shorter ones would find this motion difficult at best. Thus, just like a paper bag, or a common plastic T-shirt bag, an ordinary loaded handled bag may be taken off the bagging surface of a bagging well by pulling straight forward and then whisked upward into a shopping cart or countertop surface.

The efficacious system of mounting any one of a multitude of bag handle types or styles on cleat 410, which in turn supports it so the bag may be loaded, is of substantial importance in the emergence of the new wave of reusable bags being introduced in high volume supermarkets and retail outlets. The commonly known economic principle— productivity produces income—is of primary importance in most operations departments of major retailers. As recited in the Description of Related Art (prior art), if a few added seconds are required to prepare a bag for loading, it quickly adds up to millions of dollars annually. It may be said that operations departments with retailers consider check-out speed in the same light as fast food operations consider drive-through speeds. Even a one-second delay per customer, per order, can have a negative impact on profit and customer satisfaction. In a super market, the loss of a single customer in a day due to long lines, can represent tens of thousands of dollars a year. The mish-mash of handle types and reusable bag styles being used today represents a major drawback in mass merchandising stores, which the systems and methodology of use associated with cleat 410 can help resolve.

Figure 9A:
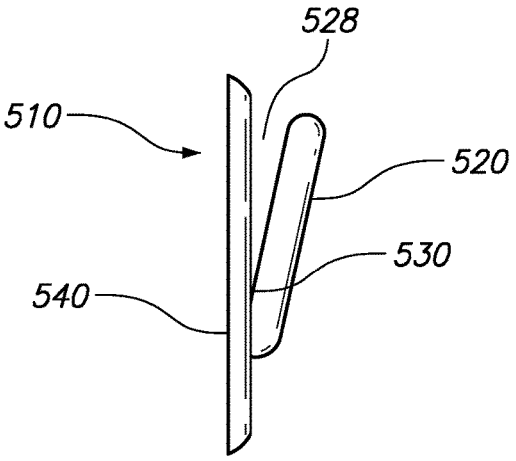
FIG. 9A is a side view of a cam cleat version of the present invention.
Figure 9B:
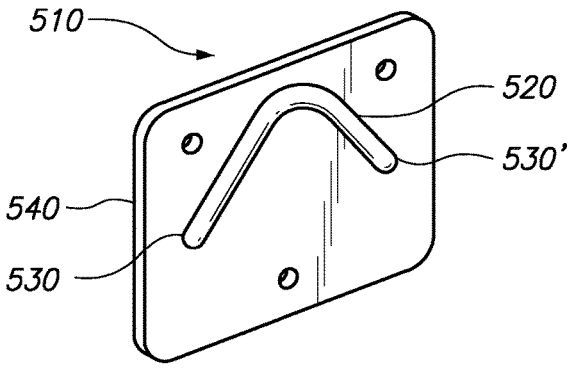
FIG. 9B is a perspective view of a cam cleat version of the present invention in FIG. 9A.
Figure 9C:
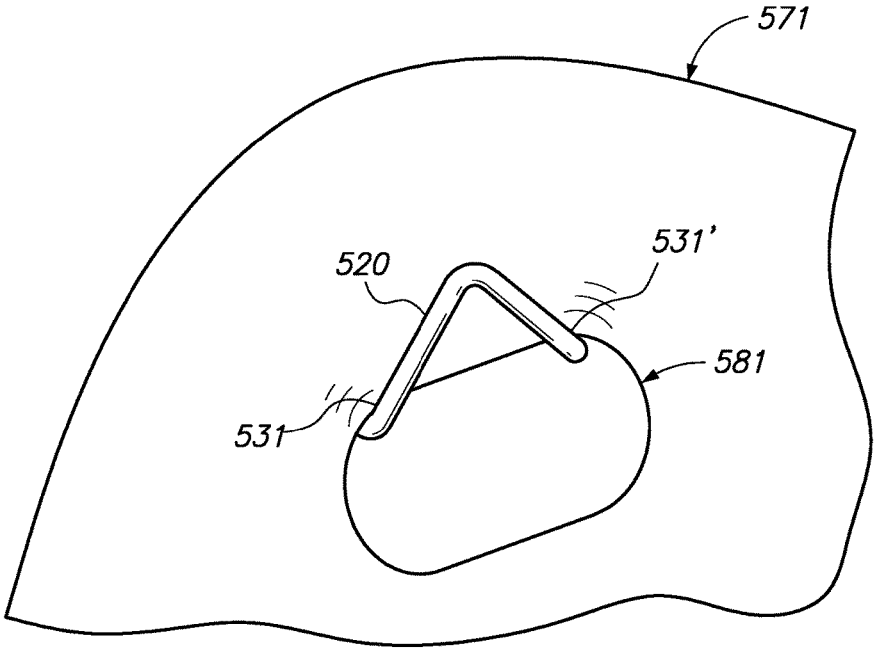
FIG. 9C is a perspective view of a cam cleat version of FIGS. 9A and 9B with a die-cut bag handle secured on it, in order to maintain a bag in an open disposition for loading.

In FIGS. 9A, 9B, and 9C, another cleat 510 constructed in accordance with the principles of the present invention includes a retainer 520, two base points 530 and 530', a back piece 540, and is further illustrated with a single bag handle 581 secured behind the retainer 520. The V-shaped gap 528 between retainer 520 and back piece 540 is tapered from top to bottom until it meets at base points 530 and 530'. In this illustration, retainer 520 is disposed at a slightly forward angle, allowing back piece 540 to mount flush up against a vertical surface, or be attached to some other type of generally vertical fixed member. Bag 570 (not shown in its entirety) would be loaded, and subsequently dispensed from the cleat much like the bags and methods illustrated with the systems used with dispenser/holder 10 and cleat 410 of FIGS. 8A, 8B, and 8C. This tapered gap serves a similar purpose as various types of cam cleats, jam cleats, and clam cleats, commonly used to secure Dacron sailing cordage (rope) on yachts. In other words, it is easy to affix a bag handle in place, yet easy to remove it when desired. This type of cleat may be made in any number of materials, but preferably plastic, metal or wire. It may be made with a one-piece solid retainer plate with a single base point running along the entire edge, or it may be made with a back piece made of wire, suitable for mounting on vertical surface or adapting to existing racks and holders.

As illustrated in FIG. 9C, handle 581 is mounted onto cleat 510 by being fixedly, yet removably clinched (or wedged as the case may be with thicker handle materials), into the bottom of the V-shaped gap above base points 530 and 530' at pinch points 531 and 531'. Once bag 571 is loaded, it may be easily removed by simply pulling more or less straight forward, whereas the flexible handle flexibly moves slightly upward, un-clinching (or un-wedging) it from the tight fit at or adjacent base point 530, and pulling the bag handle forward (or slightly upward as the case may be) and off cleat 510. With the flexible bag material dislodged from the cleat, the user may then grasp the bag, place it in a cart, or carry it as desired. This clinching/wedging operation significantly improves retaining a bag handle in place during loading, and lessens the potential of a handle accidentally "falling out" during the loading process. This type of cleat may be of a taller profile, however, it is preferred to be of a lower profile with a shorter retainer such as those of dispenser/holders 10 and 210 in order to avoid the lifting up of a filled bag as required by prior art. The versatility of V-shaped cleat 510 allows it to be effectively used to removably secure thin-handled plastic bags, thick-handled non-woven and cotton bags, and any number of loop handle, wave-top, and flush top bags with handles. The clinching/wedging operation illustrated in FIGS. 9A, 9B, and 9C may occur as illustrated with two pinch points, but it is easy to see that a clinching/wedging operation could also occur with one single pinch point, or three or more, for that matter.

Figure 9D:
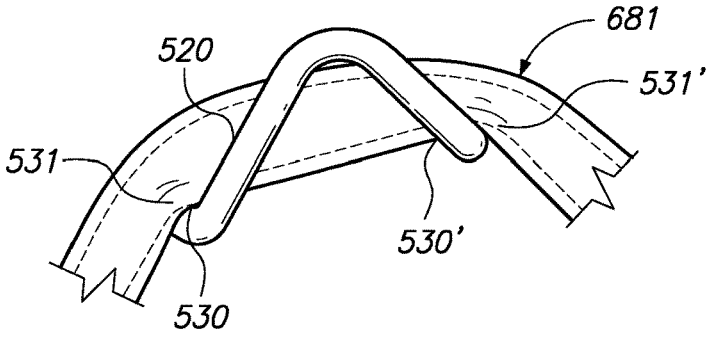
FIG. 9D is a perspective view of a cam cleat version of FIGS. 9A and 9B with a thick bag handle secured on it, in order to maintain a bag in an open disposition for loading.

In FIG. 9D, a handle 681 is of a thicker non-woven bag material and is mounted onto cleat 510 by being fixedly, yet removably, wedged into the V-shaped gap at pinch points 531 and 531' much like handle 581 in FIG. 9C. Once bag 671 (not shown) is loaded, it may be easily removed by simply pulling handle 681 slightly upward, un-wedging it from the tight fit at base points 530 and 530, and pulling the bag handle up' and off retainer 520. With this type of bag, or with a similar cotton version, securing handle 681 in cleat 510 supports bag 671 in an upright disposition, making it easier to load, and saving substantial time. In such a manner, this bag may be loaded much like that of a paper bag, providing cleat 510 is mounted above a counter top to a height that hopefully supports the open bag with its bottom reasonably squared out. Even if it is not squared-out, bags supported on cleat 510 (or cleat 410 for that matter) still helping them to stand up better making it easier for users to find the bottom and load with goods.

Figure 9E:
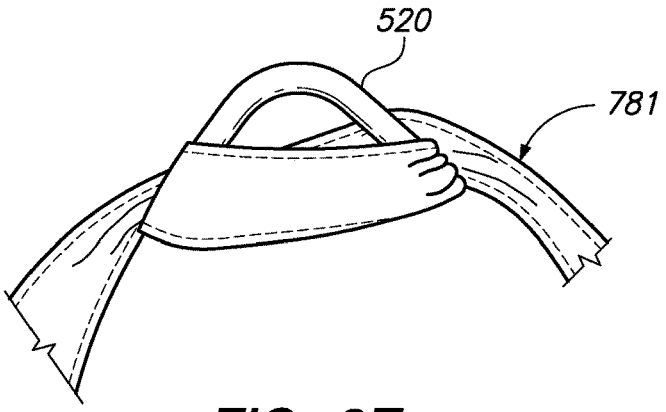
FIG. 9E is a perspective view of a cam cleat version of FIGS. 9A and 9B with a long bag handle secured on it, in order to maintain a bag in an open disposition for loading.

In FIG. 9E long loop handle 781 of a thick non-woven bag is mounted onto cleat 510 by being fixedly, yet removably, wedged into the V-shaped gap as previously described in FIG. 9D, but is also lapping around retainer 520 of cleat 510 one or more times. This operation helps position the long-handled bag 771 in a supported, generally upright disposition, with an open bag mouth, thus improving its ability to be loaded efficiently and effectively. After the loading operation is completed, the long handle 781 is unwrapped from cleat 510 and bag 771 is easily removed off a countertop or from a bagging well. This application has significant importance as most long-handled non-woven, cotton, and PET recycled sheeting bags collapse unless they are supported. They tend to be very difficult to stand up in an unsupported disposition.

Figure 9F:
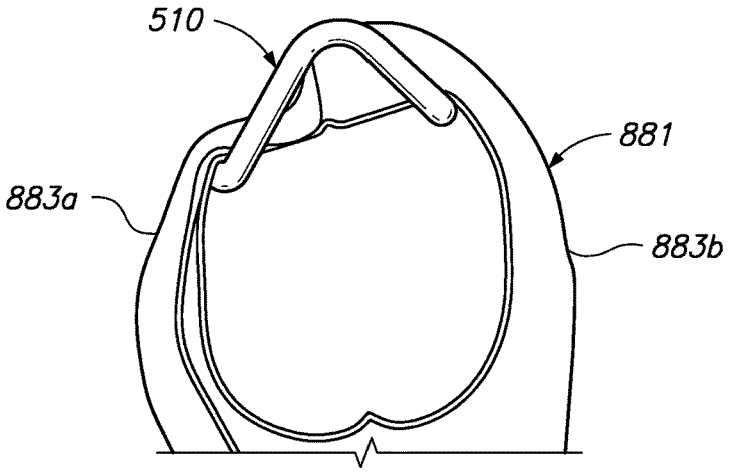
FIG. 9F is a perspective view of a cam cleat version of FIGS. 9A and 9B with a t-shirt bag handle secured on it, in order to maintain a bag in an open disposition for loading.

In FIG. 9F, the loop handle 881 of a common t-shirt bag 871 is mounted onto cleat 510 by being fixedly, yet removably, wedged into the V-shaped gap. As shown, handle portion 883*a* is folded over, and handle portion 883*b* is not. Both favorably wedge into the V-shaped gap. This operation allows the user to position and support T-shirt bag 871 (not shown) in a generally upright disposition. It is important to note that without such support, t-shirt bags are very difficult to stand upright, blouse open, and load. This is particularly cumbersome as the handles of t-shirt bags also tend to collapse inward, obstructing efficient loading of the bag. By taking a few extra seconds up front, the user of a T-shirt bag can quickly prepare it for loading, by two hands even, and save significant time afterward. There is one other important benefit from this type of loading system with a T-shirt bag, which is the tendency for the bag to be filled fuller, thus allowing it to stand up better after being loaded. While these types of bags do not generally promote standing upright after being loaded, this is a desirable improvement for consumers.

Figure 10A:
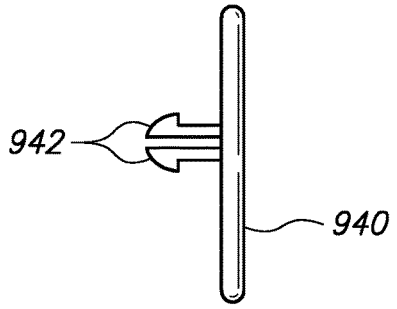
FIG. 10A is a side view of a rear bracket of the present invention that may be used as a snap in mount into an aperture-opening.
Figure 10B:
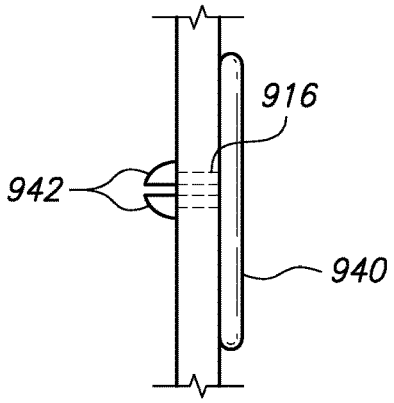
FIG. 10B is a side view of a rear bracket in FIG. 10A snapped into an aperture-opening.
Figure 10C:
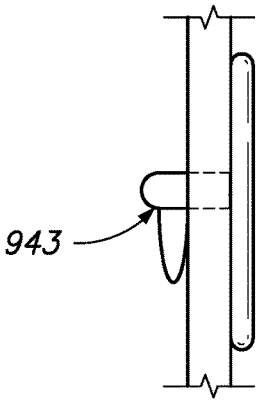
FIG. 10C is a side view of a rear bracket of the present invention that may be used as a keyed mount into an aperture-opening.

In FIGS. 10A, 10B, and 10C, the dispenser/holders much like those cited throughout FIGS. 1-9, may incorporate a unique rear bracket 940 with a quick mount system. FIGS. 10A and 10B illustrate a bracket 940, with a permanent two-part expandable insert pin 942, whereas the user snaps insert pin 942 into aperture-opening 916, securing mounting bracket 940 of a dispenser/holder (normally attached, but not shown) in place. Once snapped into place, the user mounts one or more bag packs, and then may dispense bags, much like those previously described herein. Suitable snap-in holders may consist of any number of insert pin types, including those that are expandable such as 942, or perhaps a key pin 943 as that illustrated in FIG. 10C, which are commonly used on shackles to replace the need of cotter pins. This type of easy mounting system for a variety of dispenser/holder types eliminates the need to bolt down or affix the dispenser/holder with adhesive. This type of system may be particularly effective with disposable dispenser/holders and allows a manufacturer to insert one into each carton of bags that will be used on the dispenser/holder. For example, a case of smaller food bags may contain 3000 bags and a single, inexpensive dispenser/holder of the present invention that may be quickly affixed in an aperture.

Figure 11A:
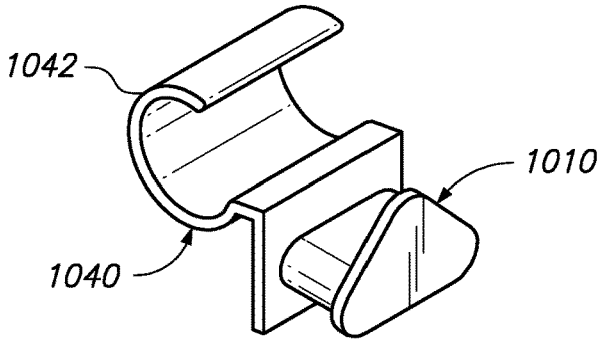
FIG. 11A is a perspective view of dispenser/holder with a rear bracket plate of the present invention that may be mounted in a slot type of aperture-opening.
Figure 11B:
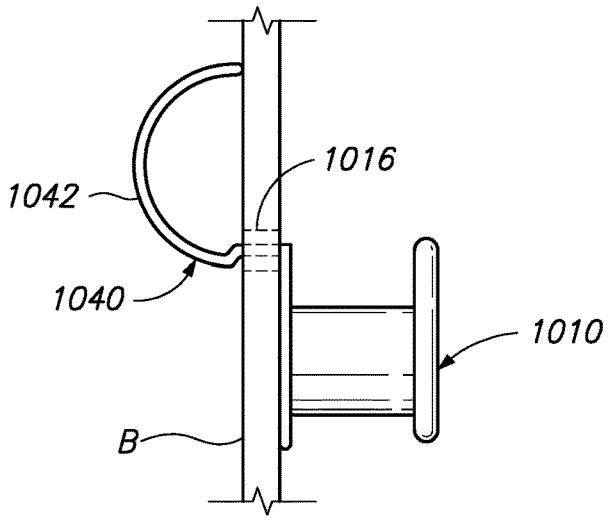
FIG. 11B is a side view of dispenser/holder of FIG. 11A mounted into a slot type of aperture-opening.

In FIGS. 11A and 11B the dispenser/holder 1010 is much like that in FIGS. 1-5, but it incorporates a unique rear bracket 1040 that has a curved plate 1042, which is used as a keyed mount into slot 1016. The user inserts curved plate 1042 into aperture-slot 1016, whereas the weight of dispenser/holder 1010 maintains it in place. Aperture-slot 1016 may be a generally open aperture, or may be a slot created by a closed door for example, such as the sheet metal doors used in various types of self-service applications in supermarkets. These metal doors located in the bulkhead behind the customer packing platform (or bagging surface), provide access in a bulkhead where wiring, electronics, and structural members are located. In such a case, a user opens the metal door, inserts a bracket on a dispenser/holder, then closes the metal door, permanently, yet removably affixing the dispenser/holder to bulkhead B. It goes without saying, that in such a case, bag packs may be mounted on the dispenser/holder for efficient use of the individual bags by consumers. It is also important to note that the example of a curved plate 1042 may be nothing more than a simple upright plate that is mounted in a zig-zag fashion in a slot. This is particularly true when a door is going to be closed upon it, thus maintaining the complete dispenser/holder and plate bracket assembly in place. It also goes without saying that dispenser/holder portion of the assembly may be substantially below or above mounting bracket 1040. This is typically determined based on the height of the slot or the gap above a door.

Figure 12:
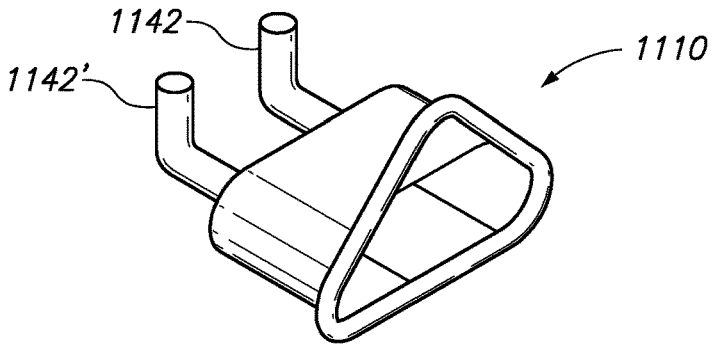
FIG. 12 is a perspective view of dispenser/holder of the present invention like that of in FIG. 6A attached to a rear bracket that may be mounted onto a pegboard surface.

In FIG. 12 dispenser/holder dispenser/holder 1110 is much like that in FIGS. 6-7, but its rear mounting bracket consists of two standard insert pegs 1142 and 1142', which may be inserted into any ordinary pegboard. After the user inserts pegs 1142 and 1142' into the pegboard, bag packs of individual bags are mounted for future use or for sale to customers. This may particularly effective when selling self-opening reusable bags like those used and sold in supermarkets, whereas the forward-most bag in sequence has its front bag wall free from the dispenser/holder retainer, thus available for immediate removal. This type of dispenser/holder being used in a resale application, may also include a means to attach signage above it. This type of pegboard insert operation may be effectively applied to dispenser/holders being mounted into slots, in door gaps, gaps between sheet metal fixtures and so on. Bags may consist of bags for resale, use with foods, bakery, deli, and so on.

Figure 13A:
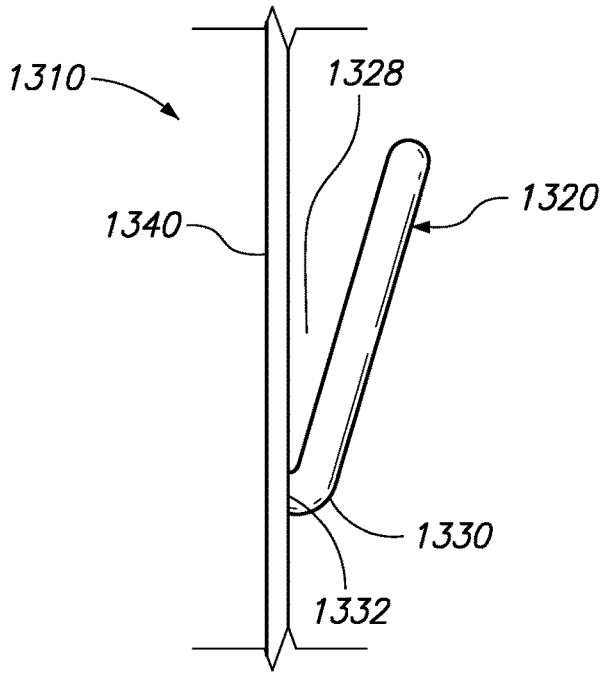
FIG. 13A is a side view of an alternative cleat embodiment constructed in accordance with the principles of the present invention.
Figure 13B:
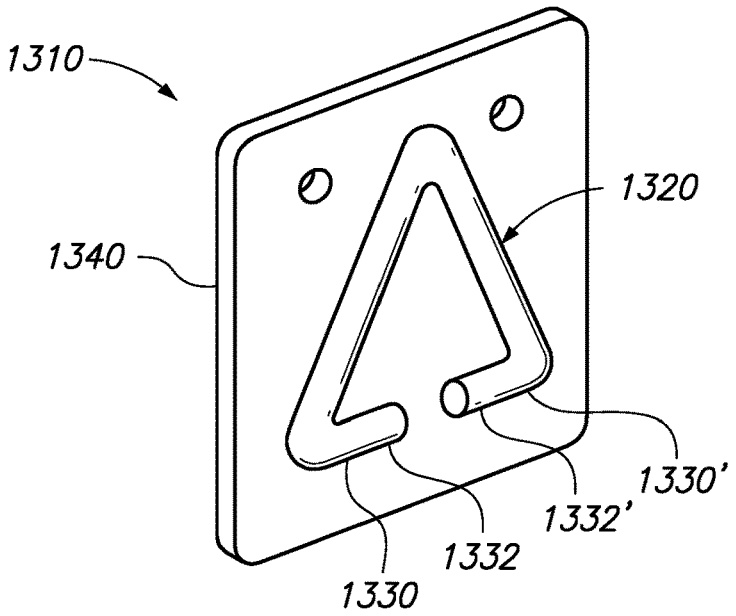
FIG. 13B is a front perspective view of the cleat of FIG. 13A.
Figure 13C:
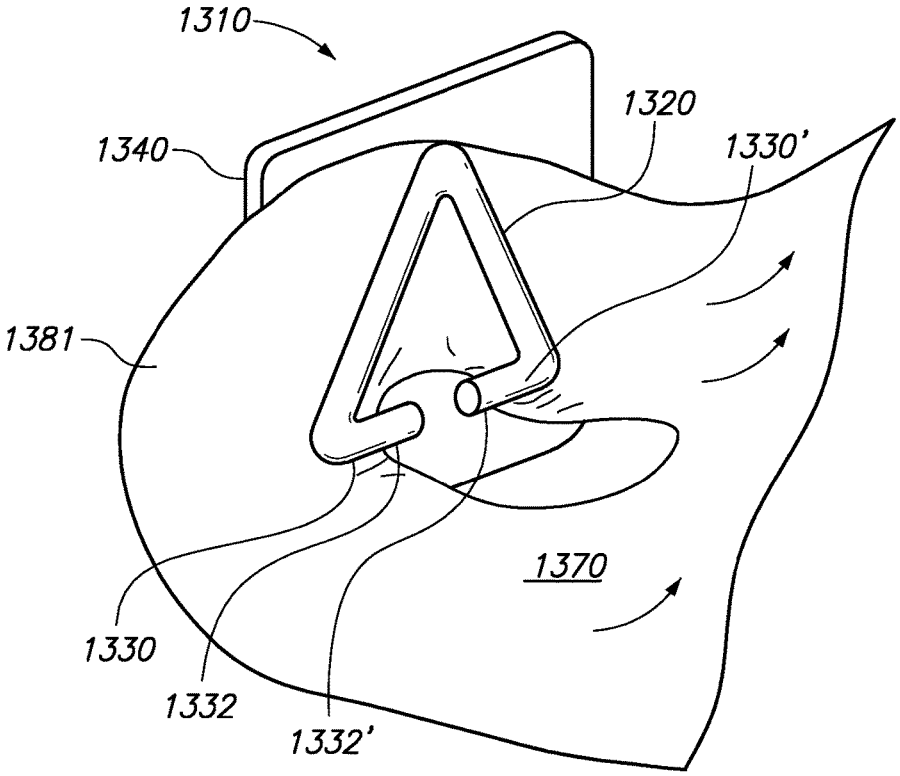
FIG. 13C is a similar view to FIG. 13B further illustrating a partial bag and handle mounted thereon.

In FIGS. 13A, 13B, and 13C, a cleat, generally designated 1310 and constructed in accordance with the principles of the present invention, is similar to that of cleat 510 in FIGS. 9A, 9B, and 9C, except that the cleat 1310 has a retainer 1320 with two inwardly disposed base points 1330 and 1330', a back piece 1340, and is further illustrated in FIG. 13C with a single bag handle 1381 secured tightly behind retainer 1320 at inwardly disposed base members 1330 and 1330' that form two inwardly disposed base points 1332 and 1332'. The V-shaped gap 1328 between retainer 1320 and back piece 1340 is tapered from top to bottom and also from the outside inward forming the two opposing pinch points at 1332 and 1332' where base members 1330 and 1330' at attached to back piece 1340. Cleat 1310 may be mounted on a vertical surface, attached to some other type of generally vertical-fixed member, or otherwise. Bag 1370 (not shown in its entirety) would be loaded, and subsequently dispensed from the cleat much like the bags and methods illustrated herein. However, the inwardly disposed base points 1332 and 1332' provide a generally superior means of securing a bag handle fixedly in place for loading by pinching and retaining bag handle 1381 onto cleat 1310 at base points 1332 and 1332' and shunting, opposing, upward and sideways movements.

As illustrated in FIG. 13C, this variation of the present invention prevents the accidental withdrawal of bag handle 1381 from cleat 1310 when handle 1381 is pulled upwards (illustrated by arrows). This accidental withdrawal may occur when a bag is taller than the mounted location of the cleat. To be firmly affixed in a sideways disposition as illustrated causes any upward movement of handle 1381 to snag on the base members 1330 and 1330', which serve as snagging members. Once the bag is loaded, it is easy to remove by simply backing out the handle from the two pinch points at inwardly disposed base points 1332 and 1332'. This type of cleat may be made in any number of materials, but preferably plastic, metal or wire. It may be made with a one-piece solid retainer plate with a single base point running along the entire edge, or it may be made with a back piece made of wire, suitable for mounting on a vertical surface or adapting to existing racks and holders. The versatility of cleat 1310 allows it to be effectively used to removably secure thin-handled plastic bags, thick-handled non-woven and cotton bags, and any number of loop handle, wave-top, and flush top bags with handles regardless of length.

Figure 14A:
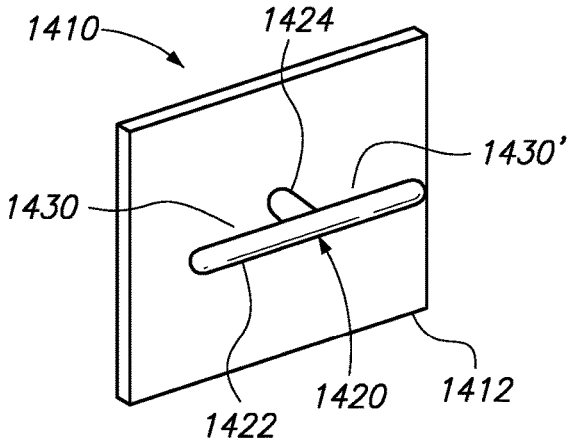
FIG. 14A is a front perspective view of an alternative cleat embodiment constructed in accordance with the principles of the present invention.
Figure 14B:
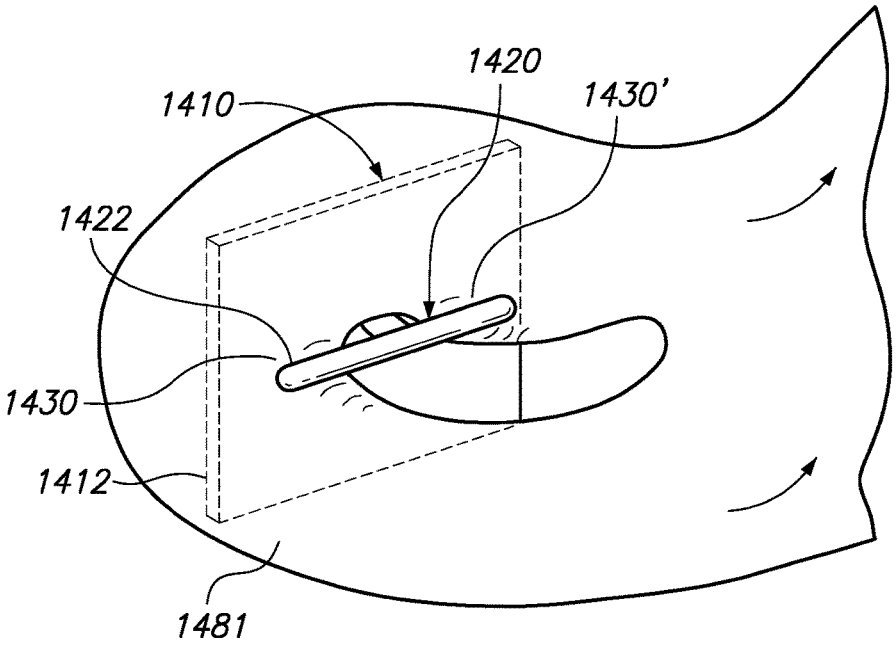
FIG. 14B is a similar view to FIG. 14B further illustrating a partial bag and handle mounted thereon.

In FIGS. 14A and 14B, a T-bar cleat, generally designated 1410 and constructed in accordance with the present invention, functions similar to that of cleat 1310 in FIGS. 13A, 13B, and 13C, except that T-bar cleat 1410 utilizes a retainer 1420 that has a horizontally disposed base 1422 attached to a perpendicular member 1424 with two inwardly disposed open sides 1430 and 1430' and thus forms no V-shaped pinch points. Perpendicular member 1424 is attached to mount 1412 and may be affixed to a vertical surface or other type of fixed member as previously described. As illustrated in FIG. 14B bag handle 1481 is mounted fixedly in place for loading by wrapping bag handle 1481 around horizontal base 1422, thus shunting, opposing, any upward (or sideways) movement. This variation of the present invention prevents the accidental withdrawal of bag handle 1481 from cleat 1410 which may occur when a bag is taller than the mounted location of the cleat. With handle 1481 being wrapped around horizontal base 1422, it causes any upward (or sideways) movement of handle 1481 to snag on base 1422 and remain in place. Once the bag is loaded, it is easy to remove by simply backing out handle 1481 through the two inwardly disposed open sides 1430 and 1430' and lifting the bag up. This type of cleat may be made in any number of styles and materials, but preferably plastic, metal or wire. It may be made with a one-piece solid retainer plate, in the shape of a ring as previously illustrated herein, or with any number of shapes and designs providing there is some form of horizontal base in which a bag may be snagged, thus preventing it from accidentally coming off the cleat.

The horizontal base 1422 on a T-bar type may be more commonly referred to as a snagging member like that of horizontal base members 1330 and 1330' of FIGS. 13A, 13B, and 13C, which snag a bag handle that may otherwise inadvertently fall off. The snagging member may be vertically or diagonally disposed and come in any number of configurations, such as an L-shape, or whatever, as long as such a cleat allows a bag handle to slide over it, yet prevents it from slipping off upwards or sideways. Regardless of how a snagging member is designed, it may be made with a back piece made of wire, suitable for mounting on a vertical surface or adapted to existing racks and holders and effectively used to removably secure thin-handled plastic bags, thick-handled non-woven and cotton bags, and any number of loop handle, wave-top, and flush top bags with handles of all sizes and shapes.

Figure 15:
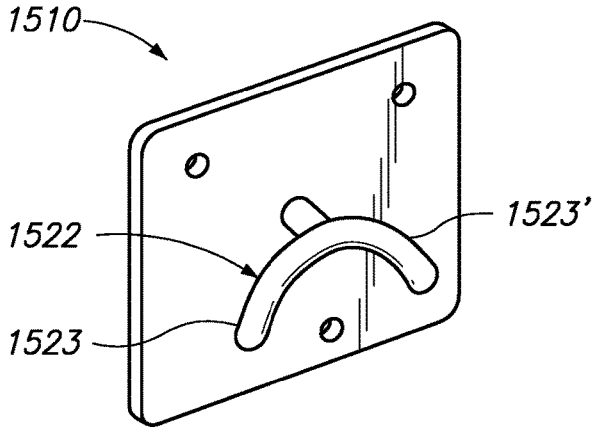
FIG. 15 is a perspective view of another alternative cleat embodiment constructed in accordance with the principle of the present invention.

In FIG. 15A, a cleat, generally designated 1510 and constructed in accordance with the principles of the present invention, functions similar to that of T-bar cleat 1410 in FIGS. 14A and 14B except that its snagging member 1522 has two additional downwards disposed members 1523 and 1523' to snag a bag handle and prevent accidental withdrawal much like that illustrated in FIG. 14B. Otherwise, cleat 1510 functions essentially the same as cleat 1410 and 1310, both of which effectively snag and retain a bag handle in place, until the user desires to release it. It may be said that a snagging member therefore, does not have to be a straight bar, horizontally, vertically, or diagonally disposed as illustrated in FIGS. 14A and 14B, but may be a simple loop or recessed portion disposed in any direction in which a bag handle is snagged. The disposition of the recessed portion may also be disposed downward, forward, backwards, sideways, or whatever the case may be in order to prevent accidental release of a bag handle. There may even be more than one recessed portion, for example, the T-bar 1410 in FIGS. 14A and 14B may have two additional loops on horizontal base 1422, one on each side of perpendicular member 1424. A recessed portion however it is applied may be a rounded loop or any number of configurations, even with a sharp-cornered or tapered disposition, as long as it serves as a snagging member. As previously discussed, cleat 1510 may also be made of any form of material, typically mounted for use on a bag in a vertical disposition so long as the loop serves as a snagging member.

It is important to note that the breadth of scope of the various types of brackets and inserts described in FIGS. 10-12 may be of a multitude of types, for a multitude of uses, and for a multitude of bag-dispensing related purposes. They may be made from various types of metals, plastics, wires, and adapters or any combination thereof. Sizing may be very small for wicketed bag replacements, or larger for certain industrial applications. The breadth of scope should not be limited to only those brackets and inserts and usages described herein. They may or may not include attachments for signage or perhaps for carrying other items such as twist ties, bag closures, advertising leaflets, and so on.

It is also important to note that the breadth of scope of the various types of dispenser/holders described in FIGS. 1-7 may also be of a multitude of types, a multitude of uses, and for a multitude of bag-dispensing related purposes. For example, mounted on a vertical bulkhead, atop a bag stand, adapted to an existing rack or holder, in a bagging well, a countertop surface, above a shelf, attached to any planar surface near a dispensing location. In the case of a wicketed bag replacement it may be placed in a generally horizontal disposition in order to accept air flow, or none at all, and to effect fast, easy removal of a filled bag with no wastage of a metal wicket or cardboard header. They may be made from various types of metals, plastics, wires, or any combination thereof. Sizing may be very small as cited for a wicketed bag replacement, or may be exceptionally large for use in industrial applications requiring handle girths suitable for carrying large, heavy, bulk bags, such as a super sack that may carry hundreds of pounds of grain. The breadth of scope shall not be limited to only those dispenser/holders and usages described herein. All of these multitudes of applications may or may not include attachments for signage or perhaps for carrying other items such as advertising leaflets, bag closures, and so on.

It is also important to note that the breadth of scope of the various types of single bag cleat holders described in FIGS. 8-9 and FIGS. 13-15 may also be of a multitude of types, a multitude of uses, and for a multitude of bag-dispensing and using purposes. It may likewise be mounted on a vertical bulkhead, atop a bag stand, adapted to an existing rack or holder, or attached to any planar surface vertical or horizontal, for subsequent dispensing. They too may be made from various types of metals, plastics, wires, or any combination thereof. Sizing may be very small as cited for a wicketed bag replacement, or may be exceptionally large for use in industrial applications requiring handle girths suitable for carrying large, heavy, bulk bags, such as a super sack that may carry hundreds of pounds of grain. The breadth of scope shall not be limited to only those dispenser/holders and usages described herein. These holders also may or may not include attachments for signage or perhaps for carrying other items such as advertising leaflets, bag closures, and so on.

Consistent with the spirit of the present inventions, and their use with an assortment of bags and bag packs, including interconnected bags and those that are not, individual bags, and the various types of bag handles used on same—they may be efficaciously dispensed from dispenser/holders and cleat holders that provide superior dispensing, usage, loading, removal, and the like. The various configurations described herein may be incorporated in whole, in part, or in combination with one another or with other types of apparatuses and the like, and located and used almost anywhere in an operation or retail facility that uses bags. Depending on the application, the efficacious use of bags on the dispensers/holders and cleats constructed in accordance with the principles of the present invention serve to significantly reduce waste, and speed up dispensing, loading, and customer and user satisfaction. The spirit of the present invention provides a breadth of scope that covers broad methodologies of which any variation on the theme and methodology of accomplishing the same that are not described herein shall be considered under the scope of the present invention.

Certain objects and advantages of the invention are described herein. Of course, it is to be understood that not necessarily all such objects or advantages may be achieved in accordance with any particular embodiment of the invention. Thus, for example, those skilled in the art will recognize that the invention may be embodied or carried out in a manner that achieves or optimizes one advantage or group of advantages as taught herein without necessarily achieving other objects or advantages as may be taught or suggested herein.

Although this invention has been disclosed in the context of certain preferred embodiments and examples, it will be understood by those skilled in the art that the present invention extends beyond the specifically disclosed embodiments to other alternative embodiments and/or uses of the invention and obvious modifications and equivalents thereof. In addition, while a number of variations of the invention have been shown and described in detail, other modifications, which are within the scope of this invention, will be readily apparent to those of skill in the art based upon this disclosure.

It is also contemplated that various combinations or sub-combinations of the specific features and aspects of the embodiments may be made and still fall within the scope of the invention. Accordingly, it should be understood that various features and aspects of the disclosed embodiments may be combined with or substituted for one another in order to form varying modes of the disclosed invention. Thus, it is intended that the scope of the present invention herein disclosed should not be limited by the particular disclosed embodiments described above.

What is claimed is:

1. A bag dispenser system comprising:

an elongated bag suspending base with an outer section and an opposing inner section including a mounting surface constructed to be secured to a support surface, the bag suspending base having an upper surface and an opposing lower surface cooperating to define a first outer profile with at least a portion of the bag suspending base being constructed to be inserted through a set of aligned front and rear handle apertures in a set of corresponding front and rear handles for each of a plurality of bags to suspend the plurality of bags from the upper surface of the bag suspending base; and a bag retainer within the outer section of the bag suspending base and extending upwardly from the upper surface of the bag suspending base to define an upper handle retention member with an uppermost perimeter spaced apart from the upper surface of the base a first distance, the upper handle retention member further including a first rearwardly facing bag handle surface, the bag retainer also extending downwardly from the lower surface of the bag suspending base to define a lower handle retention member with a lowermost perimeter spaced apart from the lower surface of the base a second distance less than the first distance, the lower handle retention member further including a second rearwardly facing bag handle surface, the perimeters of the retention members defining an enlarged outwardly facing, non-circular, retainer profile relative to the first outer profile of the bag suspending base, the upper and lower retention members being constructed to insert through the handle apertures of the plurality of bags to dispose the front and rear handles of the plurality of bags initially between the rearwardly facing bag handle surfaces of the retention members and the support surface when the bag suspending base is mounted thereon, the bag retainer further constructed to permit withdrawal of a front handle of a single bag from the bag retainer and the bag suspending base when the front handle is pulled away in a first direction from the bag retainer without lifting motion while the upper and lower retention members cooperate to resist removal and releasably retain the rear handle of the same bag on the base at least partially behind at least one retention member to space apart the front and rear handles of the corresponding bag and present an open loaded configuration wherein the bag may be loaded with one or more items and then the same bag may be further released completely from the bag suspending base and the bag retainer by pulling the same bag again in the same direction as the first direction while the upper retention member assists in separating the rear handle of the same bag from the front handle of an adjacent bag remaining on the bag suspending base.

2. The bag dispenser system of claim 1 further including:

a self-opening bag pack releasably secured on and suspended from the base behind the retention members, the self-opening bag pack including a plurality of self-opening bags with each self-opening bag having a front panel with a front handle defining a front handle aperture and a rear panel with a rear handle defining a rear handle aperture aligned with the front handle aperture, each bag further including a bottom gusset between the front panel and the rear panel that expands when the front handle is withdrawn from the retainer.

3. The bag dispenser system of claim 1 further including:

a plurality of bags secured on and suspended from the bag suspending base behind the retention members, each bag having a front panel with a front handle defining a front handle aperture and a rear panel with a rear handle defining a rear handle aperture aligned with the front handle aperture.

4. The bag dispenser system of claim 1 wherein:

the upper retention member extends up to one inch from at least a portion of the upper surface of the base; and the lower retention member extends up to a ¼ inch from at least a portion of the lower surface of the base.

5. The bag dispenser system of claim 1 wherein:

the base further includes a left side surface and a right side surface with the upper, lower, left side, and right side surfaces cooperating to define the first outer profile of the base; and the retainer includes a left side retainer member extending outwardly from the left side surface of the base and a right side retainer member extending outwardly from the right side surface of the base.

6. The bag dispenser system of claim 1 wherein:

the base is secured to the support surface at a height wherein the bottom of one or more bags suspended from the base rest on an underlying support surface.

7. The bag dispenser system of claim 1 wherein:

the first outer profile of the base is in the shape of an oval racetrack as defined by the meeting of an upper concave curved surface and a lower convex curved surface; and the retention members project at right angles to the curved surface and the first direction is substantially perpendicular to the retention members.

8. The dispenser of claim 1 wherein:

the upper retention member resists without completely inhibiting the withdrawal of either the front handle or the rear handle when the front panel or front handle of the outermost bag is pulled in the first direction; and the lower retention member resists without completely inhibiting the withdrawal of either the front handle or the rear handle when the front panel or front handle of the outermost bag is pulled in the first direction.

9. The dispenser of claim 1 wherein:

the retention members cooperate to ensure the bags are removed one at a time from the retainer.

10. The bag dispenser system of claim 3 wherein:

the front handle apertures and rear handle apertures of the plurality of bags have an opening that is smaller is diameter than the retainer profile defined by the upper and lower handle retention members.

11. The bag dispenser system of claim 1 wherein:

the upper perimeter of the upper handle retention member includes a first radius of curvature defining a narrow apex region and the lower perimeter of the lower handle retention member is substantially planar.

* * * * *